US009423755B2

(12) United States Patent
Numazu et al.

(10) Patent No.: US 9,423,755 B2
(45) Date of Patent: Aug. 23, 2016

(54) PRINTING APPARATUS, PRINTING SYSTEM, PRINTING METHOD AND NON-TRANSITORY RECORDING MEDIUM

(71) Applicant: CASIO COMPUTER CO., LTD., Shibuya-ku, Tokyo (JP)

(72) Inventors: Toshihiko Numazu, Sayama (JP); Toshio Nagasaka, Iruma (JP); Toshiaki Yajima, Iruma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/562,171

(22) Filed: Dec. 5, 2014

(65) Prior Publication Data

US 2015/0177666 A1 Jun. 25, 2015

(30) Foreign Application Priority Data

Dec. 25, 2013 (JP) ..... 2013-266523

(51) Int. Cl.

| | |
|---|---|
| ***B65H 18/00*** | (2006.01) |
| ***G03G 15/00*** | (2006.01) |
| ***B65H 18/02*** | (2006.01) |
| ***B65H 18/10*** | (2006.01) |

(52) U.S. Cl.

CPC ..... *G03G 15/6517* (2013.01); *B65H 18/026* (2013.01); *B65H 18/103* (2013.01); *G03G 15/652* (2013.01); *B65H 2301/41461* (2013.01); *B65H 2511/512* (2013.01); *B65H 2801/06* (2013.01); *G03G 2215/00021* (2013.01); *G03G 2215/00455* (2013.01)

(58) Field of Classification Search

CPC ..... G03G 15/36; G03G 15/6517; G03G 2215/00455; G03G 2215/00459; G03G 2215/00578; G03G 2215/0103; G03G 2215/0106; G03G 2215/0426; G03G 2215/0468; G03G 2215/048; G03G 15/562; B65H 18/026; B65H 18/103; B65H 2301/4165

See application file for complete search history.

(56) References Cited

U.S. PATENT DOCUMENTS

| | | | | |
|---|---|---|---|---|
| 7,603,064 | B2 * | 10/2009 | Ishida | G03G 15/0115 399/223 |
| 8,503,919 | B2 | 8/2013 | Sone et al. | |
| 8,939,666 | B2 * | 1/2015 | Tamai | B65H 23/1882 347/104 |
| 9,025,987 | B2 * | 5/2015 | Shindo | G06F 3/1208 399/79 |

FOREIGN PATENT DOCUMENTS

| | | | |
|---|---|---|---|
| JP | 11-249346 A | * | 9/1999 |
| JP | 2011174984 A | | 9/2011 |

* cited by examiner

*Primary Examiner* — Justin Olamit
(74) *Attorney, Agent, or Firm* — Holtz, Holtz & Volek PC

(57) ABSTRACT

A printing apparatus prints an image on a recording medium unwound by an unwinder. The recording medium is wound around a first winding shaft in order from a beginning edge to an ending edge of the recording medium. The wound recording medium is rewound, and the rewound recording medium is wound around a second winding shaft in order from the ending edge to the beginning edge of the recording medium.

14 Claims, 19 Drawing Sheets

PRINTING APPARATUS, PRINTING SYSTEM, PRINTING METHOD AND NON-TRANSITORY RECORDING MEDIUM

CROSS-REFERENCE TO RELATED APPLICATION

This application claims the benefit of Japanese Patent Application No. 2013-266523, filed on Dec. 25, 2013, the entire disclosure of which is incorporated by reference herein.

FIELD

This application relates generally to a printing apparatus, printing system, printing method and non-transitory recording medium.

BACKGROUND

As a recording medium for an image-forming apparatus such as a printer, a copier, a facsimile machine and/or the like to form images, a roll-wound recording medium (hereafter called roll paper) in which a recording medium such as paper, film and/or the like is wound around a roll shape exists. The roll paper can be stored without needing to be cut, and thus is widely used when accomplishing large-area image formation without a break, for example in a label printer continuously printing multiple labels or seals.

Accompanying increases in printing quality with digital printing, even with large-area printing using roll paper, quality close to that of printed materials such as flexography, gravure printing, offset printing and/or the like is needed. Consequently, printing with white, transparent and other colors on the roll paper is demanded, in addition to the four colors of YMCK (yellow (Y), magenta (M), cyan (C) and black (K)) that can be used with typical color printers under a four-way tandem method.

Printers corresponding to five-way or more tandem methods are known as a method of adding white and/or other colors to the four colors of YMCK in color printers (for example, see Unexamined Japanese Patent Application Kokai Publication No. 2011-174984).

In addition, a method of creating the K color (black) out of YMCK by superimposing the three colors of YMC (process black) and adding another color in place of the K color is known.

SUMMARY

A printing apparatus according to a first aspect of the present disclosure comprises:

a printing unit that prints images on a recording medium unwound by an unwinder;

a first winder that winds the printed recording medium around a first winding shaft in order from a beginning edge to an ending edge of the recording medium; and a second winder that rewinds the recording medium wound around the first winding shaft, and winds the rewound recording medium around a second winding shaft in order from the ending edge to the beginning edge of the recording medium.

A printing system according to a second aspect of the present disclosure comprises:

a first image-forming unit that forms a first developing agent image on a recording medium unwound by a first unwinder;

a first winder that winds the recording medium on which the first developing agent image was formed around a first winding shaft in order from a beginning edge to an ending edge of the recording medium;

a second winder that rewinds the recording medium wound around the first winding shaft, and winds the unwound recording medium around a second winding shaft in order from the ending edge to the beginning edge of the recording medium;

a second unwinder that unwinds the recording medium wound around the second winding shaft in order from the beginning edge to the ending edge of the recording medium; and a second image-forming unit that forms a second developing agent image on a surface of the recording medium unwound by the second unwinder on which the first developing agent image was formed.

A printing method according to a third aspect of the present disclosure includes:

forming a first developing agent image on an unwound recording medium;

winding the recording medium on which the first developing agent image was formed around a first winding shaft, in order from a beginning edge to an ending edge of the recording medium;

rewinding the recording medium wound around the first winding shaft, and winding the rewound recording medium around a second winding shaft, in order from the ending edge to the beginning edge of the recording medium;

unwinding the recording medium wound around the second winding shaft, in order from the beginning edge to the ending edge of the recording medium; and forming a second developing agent image on a surface of the unwound recording medium on which the first developing agent image was formed.

A non-transitory computer-readable recording medium according to a fourth aspect of the present disclosure has stored thereon a program executable by a computer, the program controlling the computer to perform functions comprising:

forming a first developing agent image on an unwound recording medium;

winding the recording medium on which the first developing agent image was formed around a first winding shaft, in order from a beginning edge to an ending edge of the recording medium;

rewinding the recording medium wound around the first winding shaft, and winding the rewound recording medium around a second winding shaft, in order from the ending edge to the beginning edge of the recording medium;

unwinding the recording medium wound around the second winding shaft, in order from the beginning edge to the ending edge of the recording medium; and forming a second developing agent image on a surface of the unwound recording medium on which the first developing agent image was formed.

BRIEF DESCRIPTION OF THE DRAWINGS

A more complete understanding of this application can be obtained when the following detailed description is considered in conjunction with the following drawings, in which.

DETAILED DESCRIPTION

Figure 1:
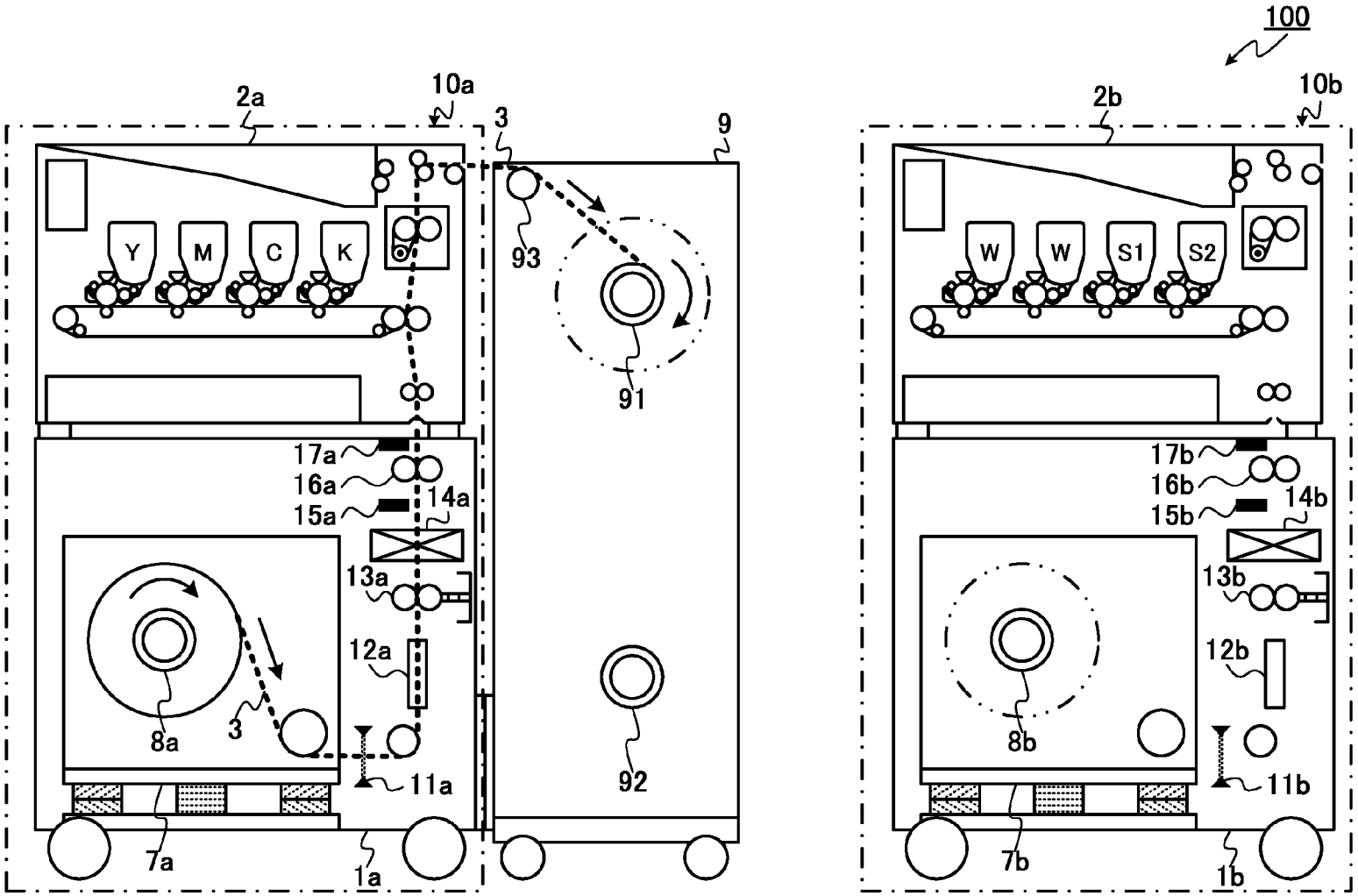
FIG. 1 is a drawing showing the composition of a printing system according to a first exemplary embodiment of the present disclosure.

Below, the exemplary embodiments of the present disclosure are described with reference to the drawings. Parts that are the same or corresponding in the drawings are labeled with the same reference symbols.

First Exemplary Embodiment

FIG. 1 shows the composition of a printing system according to a first exemplary embodiment. The printing system 100 comprises a normal color printing system 10*a* comprising a paper supply apparatus 1*a* and an image-forming apparatus 2*a*, a special color printing system 10*b* comprising a paper supply apparatus 1*b* and an image-forming apparatus 2*b*, and a winding apparatus 9. The printing system 100 prints in multiple colors on roll paper 3 that is a roll-wound recording medium, by using the normal color printing system 10*a* and the special color printing system 10*b*.

The paper supply apparatus 1*a* provided in the normal color printing system 10*a* supplies the roll paper 3 to the image-forming apparatus 2*a*. The paper supply apparatus 1*a* continuously unwinds the roll paper 3 in which paper is wound in a rolled sate around a prescribed winding core (paper tube) and conveys the roll paper 3 to the image-forming apparatus 2*a* along a prescribed conveyance path. Specifically, the paper supply apparatus 1*a* comprises a slide table 7*a*, a holder 8*a*, an incline detection sensor 11*a*, a side guide 12*a*, a paired conveyor roller 13*a*, an auto cutter 14*a*, a mark sensor 15*a*, a paired feed roller 16*a* and a feed sensor 17*a*.

The holder 8*a* functions as a first holder and holds the roll paper 3 prior to an image being formed by the image-forming apparatus 2*a*. The holder 8*a* comprises a rotatable rotation shaft that holds the roll paper 3 via the winding core at the winding center of the roll paper 3, and a support table that supports the rotation shaft, and supports the roll paper 3 so that rotation is possible.

An unrepresented motor for causing the rotation shaft to rotate is mounted in the holder 8*a*. The holder 8*a* functions as an unwinder that unwinds the roll paper 3 held by causing the rotation shaft to rotate an indicated number of rotations per unit time (the number of times rotated per unit time) under driving by the motor.

In addition, an unrepresented powder brake is attached to the rotation shaft of the holder 8*a*. The powder brake applies a brake to rotation of the rotation shaft so that the tension applied to the roll paper conveyed by being unwound from the holder 8*a* is kept constant. Through the function of the powder brake, the roll paper 3 unwound from the holder 8*a* is conveyed stably without slackening.

The slide table 7*a* is provided with a slide bearing on both sides and causes the holder 8*a* to slide in the direction of the rotation shaft (the sideways direction of the roll paper 3). When the slide table 7*a* detects an incline of the roll paper 3 conveyed inside the paper supply apparatus 1*a*, drive force is obtained through an actuator and causes the holder 8*a* to move in a direction to negate the detected incline.

The incline detection sensor 11*a* detects inclines of the roll paper 3 conveyed inside the paper supply apparatus 1*a*. Specifically, the incline detection sensor 11*a* comprises multiple sets of light-emitting elements and light-receiving elements positioned so that interposed in between is the end of the roll paper 3 in the sideways direction. The incline detection sensor 11*a* determines the position deviation of the end of the roll paper 3 in the sideways direction without contacting the roll paper 3, by determining whether or not light emitted from the light-emitting elements is received by the light-receiving elements without being blocked, for each of the multiple sets.

The paired conveyor roller 13*a* sandwiches and conveys the roll paper 3 unwound from the holder 8*a* and conveyed via the following roller and the side guide 12*a*, and supplies the roll paper 3 to the paired feed roller 16*a*. The paired feed roller 16*a* sandwiches and conveys the roll paper 3 supplied from the paired conveyor roller 13*a*, and supplies the roll paper 3 to the image-forming apparatus 2*a*.

The auto cutter 14*a* cuts the roll paper 3 as necessary. The auto cutter 14*a* cuts the final end (back edge) of the roll paper 3 for example when roll paper 3 of a length necessary for image formation in the image-forming apparatus 2*a* has finished being conveyed.

The mark sensor 15*a* detects an original mark recorded on the surface of the roll paper and used by the image-forming apparatus 2*a* as a position reference for forming images. Specifics of the original mark are described below.

The feed sensor 17*a* detects the beginning edge (front edge) of the roll paper 3 fed to the image-forming apparatus 2*a* from the paired feed roller 16*a*. Specifically, the feed sensor 17*a* comprises a light-emitting element and a light-receiving element, and determines that the beginning edge of the roll paper 3 has been detected when light emitted from the light-emitting element is blocked by the beginning edge of the roll paper 3 and is not detected by the light-receiving element. When the feed sensor 17*a* detects the beginning edge of the roll paper 3, the image-forming apparatus 2*a* starts driving of the various types of roller pairs and causes the roll paper 3 fed to the inside to be conveyed.

The paper supply apparatus 1*b* with which the special color printing system 10*b* is equipped supplies roll paper 3 to the image-forming apparatus 2*b* as a recording medium for image formation. Specifically, the paper supply apparatus 1*b* comprises a slide table 7*b*, a holder 8*b*, an incline detection sensor 11*b*, a slide guide 12*b*, a paired conveyor roller 13*b*, an auto cutter 14*b*, a mark sensor 15*b*, a paired feed roller 16*b* and a feed sensor 17*b*. The holder 8*b* functions as a second holder and holds the roll paper 3 after an image is formed by the first image-forming apparatus 2*a* and the paper is wound by a winder 97. The paper supply apparatus 1*b* has the same composition as the above-described paper supply apparatus 1*a*, so detailed explanation of the various constituent elements comprising the paper supply apparatus 1*b* is omitted.

A winding apparatus 9 comprises a first winding shaft 91, a second winding shaft 92 and a guide roller 93. The winding apparatus 9 functions as a rewinder, and winds and holds the roll paper 3 ejected from the image-forming apparatus 2*a* and conveyed via the guide roller 93 around the first winding shaft 91. In addition, the winding apparatus 9 unwinds the roll paper 3 wound around the first winding shaft 91, and again winds the roll paper 3 around the second winding shaft 92.

Figure 2A:
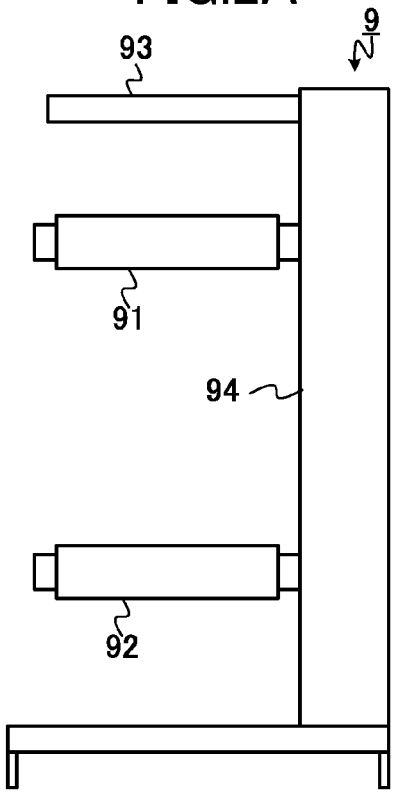
FIG. 2A is side view of a winding apparatus.
Figure 2B:
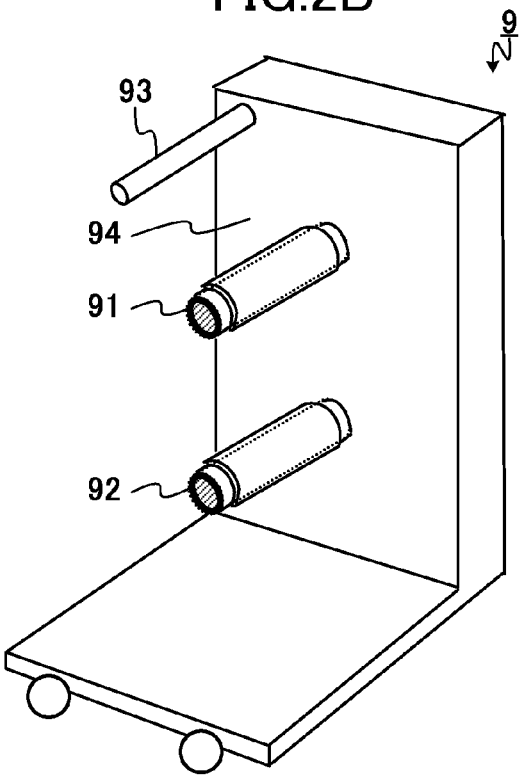
FIG. 2B is an oblique view of the winding apparatus.

More specifically, as shown in FIG. 2A and FIG. 2B, the first winding shaft 91, the second winding shaft 92 and the guide roller 93 are positioned on a side surface 94 so that the respective shaft directions are perpendicular to the common side surface 94 in the winding apparatus 9. Because the first winding shaft 91 and the second winding shaft 92 are positioned on the common side surface 94, it is possible for the first winding shaft 91 to unwind the wound roll paper 3 and for the second winding shaft 92 to smoothly wind the roll paper 3 again. In addition, the winding apparatus 9 is provided on the bottom with wheels for moving and can be mounted on either the normal color printing system 10*a* or and the special color printing system 10*b*.

Unrepresented motors are provided in the first winding shaft 91 and the second winding shaft 92, and wind the roll paper 3 by rotating at a number of rotations per unit time specified through driving by the motors. In addition, the first winding shaft 91 is provided with a clutch mechanism for interrupting the transfer of drive power from the motor when excessively large torque is applied. Through this, the roll paper 3 that is being wound is prevented from being pulled excessively tight so that the precision of image formation declines.

The image-forming apparatus 2*a* with which the normal color printing system 10*a* is equipped is placed on top of the paper supply apparatus 1*a* and functions as a first image-forming unit that forms (transfers and fixes) a first developing agent image through developing agent in the four colors of YMCK (yellow (Y), magenta (M), cyan (C) and black (K)) based on image data of the printing target, and forms the first developing agent image on the roll paper 3 supplied from the paper supply apparatus 1*a*. The image-forming apparatus 2*b* with which the special color printing system 10*b* is equipped is placed on top of the paper supply apparatus 1*b* and functions as a second image-forming unit that forms a second developing agent image through developing agent of special colors not included in the four colors of YMCK and forms the second developing agent image on the roll paper 3 supplied from the paper supply apparatus 1*b*.

The internal compositions of the image-forming apparatus 2*a* and the image-forming apparatus 2*b* is described with reference to FIG. 3A and FIG. 3B. Below, the image-forming apparatus 2*a* and the image-forming apparatus 2*b* are described by taking as an example a secondary transfer-type tandem color printer of electronic photo format. In addition, the explanation below takes as an example a case in which toner is used as the developing agent.

Figure 3A:
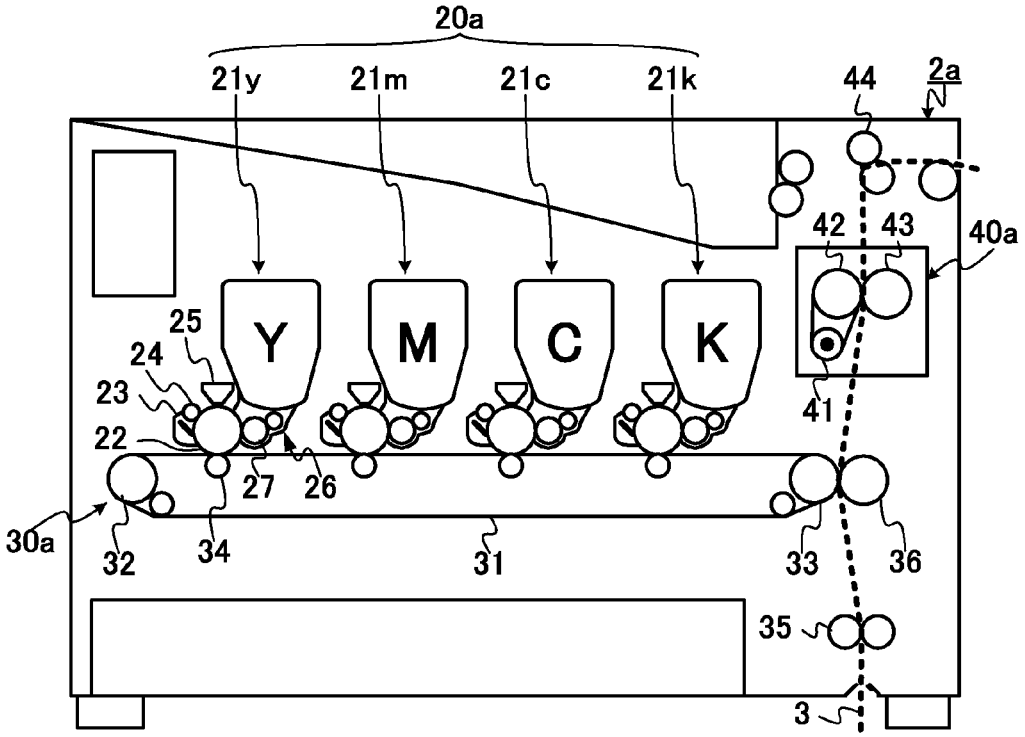
FIG. 3A is a cross-sectional view showing the internal composition of a first image-forming apparatus.

As shown in FIG. 3A, the image-forming apparatus 2*a* comprises an image-forming unit 20*a*, an intermediate transfer belt unit 30*a* and a fuser apparatus 40*a*.

The image-forming apparatus 20*a* is provided with a composition in which four Image-forming parts 21*y*, 21*m*, 21*c* and 21*k* are arranged linearly. The Image-forming parts 21*y*, 21*m* and 21*c* form color images through color toner of yellow (Y), magenta (M) and cyan (C), which are the three primary colors of subtractive mixture colors. On the other hand, the Image-forming part 21*k* forms monochrome images of black (K) toner used primarily in text and dark parts of images, and or the like.

Each of the Image-forming parts 21 comprises a photosensitive drum 22 at the bottom. This photosensitive drum 22 comprises an organic photoconductive material, for example, on a cylinder surface. Near the photosensitive drum 22, a cleaner 23, a charged roller 24, an optical writing head 25 and a developing roller 27 of a developer 26 are positioned as though surrounding the cylinder surface.

The developer 26 stores toner of yellow (Y), magenta (M), cyan (C) and black (K) in a toner container positioned on top, in the center is provided with a toner replenishing mechanism to the bottom, and on the bottom is provided with the developing roller 27. The developer 26 is further equipped with a toner stirrer inside, a toner supply roller for supplying toner to the developing roller 27, and a doctor blade for regulating the toner layer on the developing roller 27 to a constant thickness.

Figure 3B:
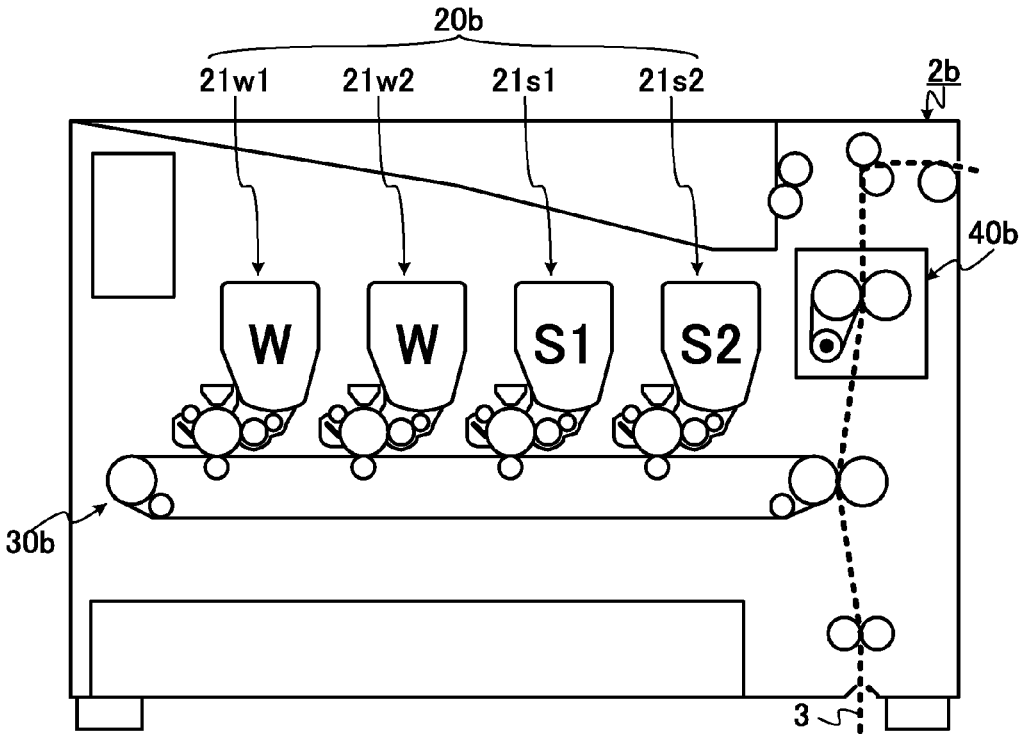
FIG. 3B is a cross-sectional view showing the internal composition of a second image-forming apparatus.

Reference symbols are appended to only the composition of the Image-forming part 21*y* for yellow (Y) in FIG. 3A and FIG. 3B, but each of the Image-forming parts 21 (21*y*, 21*m*, 21*c*, 21*k*, 21*w*1, 21*w*2, 21*s*1 and 21*s*2) have the same composition excepting for the color of the toner stored in the toner container.

The intermedia transfer belt unit 30*a* comprises an endless transfer belt 31 extending in a flat loop shape substantially in the center of the image-forming apparatus 2*a*; a driving roller 32 over which the transfer belt 31 is passed, the driving roller 32 causing the transfer belt 31 to circulate and move in a counter-clockwise direction; and a following roller 33. The transfer belt 31 conveys the toner image transferred (primary transfer) directly to the belt surface to the transfer position so that toner image on the belt surface can transfer (secondary transfer) to the roll paper 3.

The intermediate transfer belt unit 30*a* is provided with four primary transfer rollers 34 corresponding to the four Image-forming parts 21*y*, 21*m*, 21*c*, 21*k*, within the loop of the transfer belt 31. The primary transfer rollers 34 comprise conductive foam sponges for pressing against the bottom cylinder surface of the photosensitive drum 22 via the transfer belt 31, and rotate with a specified rotation period and cause the transfer belt 31 to abut the photosensitive drum 22 and separate from the photosensitive drum 22.

A paired standby conveyor roller 35 receives the roll paper 3 supplied from the paper supply apparatus 1 via a feed opening for expansion paper supply, and conveys the roll paper 3 received to a secondary transfer roller 36. The secondary transfer roller 36 is positioned so as to press against the following roller 33 via the transfer belt 31, and forms a secondary transfer unit that makes a secondary transfer to the roll paper 3 of the toner image transferred to the belt surface of the transfer belt 31.

The fuser apparatus 40*a* comprises a heating roller 42 into which a heater 41 is built, and a pressure roller 43 that presses against the heating roller 42. The fixing apparatus 40*a* heats and presses on, thereby fixing, the unfixed toner on the roll paper 3 after secondary transfer.

In addition, on the downstream side of the fuser apparatus 40*a*, a paper discharge roller pair 44 is positioned for discharging the roll paper 3 from the image-forming apparatus 2*a* after toner fixing. The roll paper 3 that has passed through the paper discharge roller pair 44 is discharged from the image-forming apparatus 2*a* and is wound by the winding apparatus 9.

As shown in FIG. 3B, the image-forming apparatus 2*b* comprises an image-forming unit 20*b*, an intermediate transfer belt unit 30*b* and a fuser apparatus 40*b*. The image-forming apparatus 2*b* has the same composition as the image-forming apparatus 2*a* with the exception of the color of toner stored in the four Image-forming parts 21*w*1, 21*w*2, 21*s*1 and 21*s*2 in the image-forming unit 20*b*. Consequently, detailed description of the other constituent elements comprising the image-forming apparatus 2*b* is omitted.

The image-forming unit 20*b* is provided with a composition in which four Image-forming parts 21*w*1, 21*w*2, 21*s*1 and 21*s*2 that form images using toner of colors not including the four colors of YMCK are arranged linearly. By using toner of special colors, it is possible to express colors that cannot be expressed by the four colors of YMCK and it is possible to increase the quality of printed materials.

Specifically, the Image-forming parts 21*w*1 and 21*w*2 both comprise toner containers containing white (W) toner and form images with white toner. That is to say, the image-forming apparatus 2*b* forms white toner images respectively with the two Image-forming parts 21*w*1 and 21*w*2, and forms white images by superimposing the two white toner images on the transfer belt 31. By superimposing two white toner images, it is possible to express images with white of sufficient depth without the base colors becoming transparent, even when for example images are formed in areas where base colors such as black or red are deep.

On the other hand, the Image-forming parts 21*s*1 and 21*s*2 respectively comprise toner containers containing toner of special colors other than white and form images through the special-colored toner. As special colors other than white, gold, silver, transparent (invisible) colors that emit light when irradiated with ultraviolet rays and special colors for providing fluorescent light or gloss, and/or the like, can be cited. The Image-forming parts 21*s*1 and 21*s*2 form images through toner of at least one or more of these colors.

Figure 4:
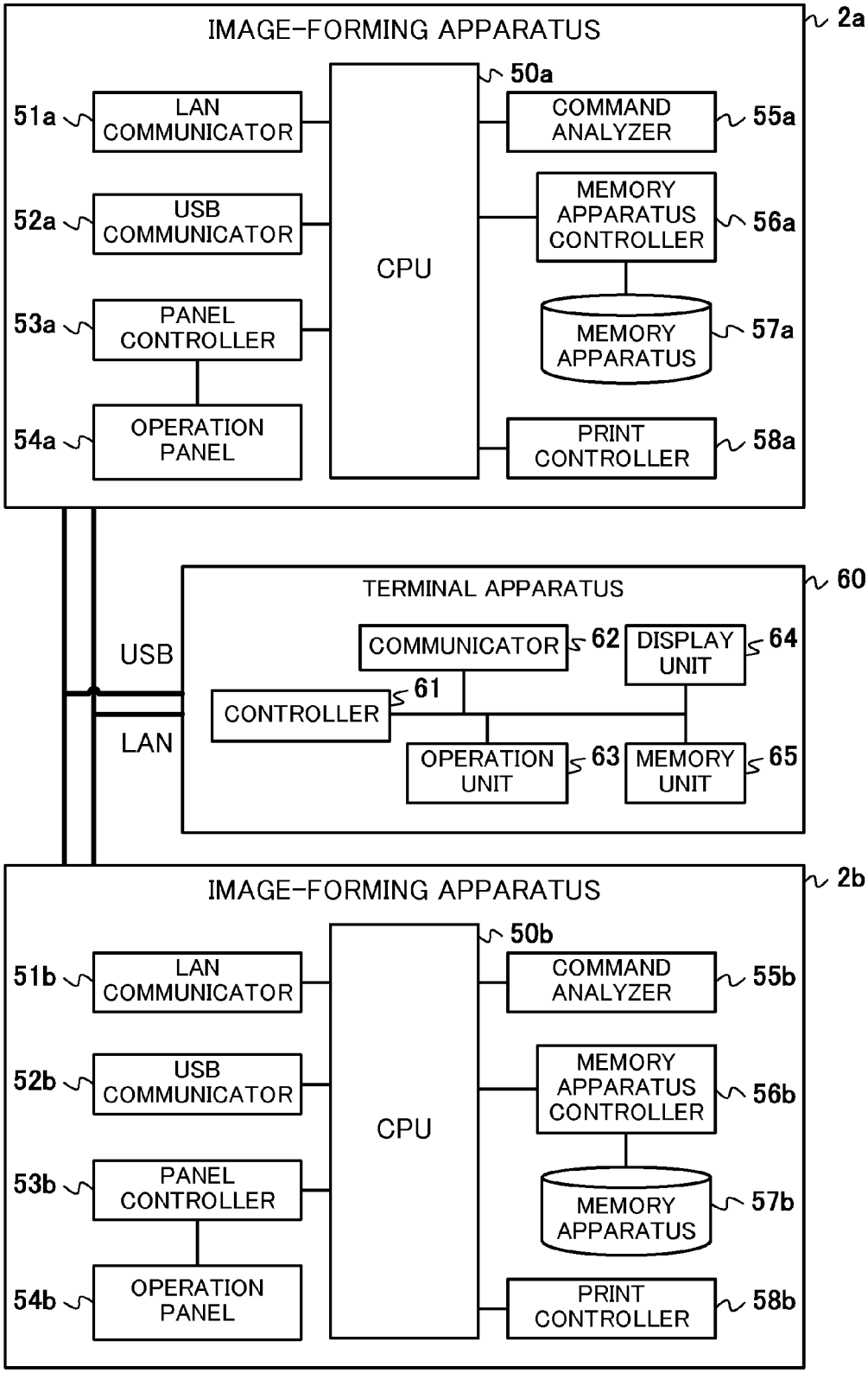
FIG. 4 is a block diagram showing a composition relating to control of the first image-forming apparatus, the second image-forming apparatus and a terminal apparatus.

Next, referring to FIG. 4, the composition relating to control of the image-forming apparatus 2*a* and the image-forming apparatus 2*b* is described. The image-forming apparatus 2*a* and the image-forming apparatus 2*b* are connected to each other by a terminal apparatus 60 and a network such as a LAN (Local Area Network) and/or the like or a USB (Universal Serial Bus).

The image-forming apparatus 2*a* comprises a CPU (Central Processing Unit) 50*a*, a LAN communicator 51*a*, a USB communicator 52*a*, a panel controller 53*a*, an operation panel 54*a*, a command analyzer 55*a*, a memory apparatus controller 56*a*, a memory apparatus 57*a* and a print controller 58*a*.

The CPU 50*a* is connected to the various components of the image-forming apparatus 2*a* via a system bus that is a transmission route for transmitting commands and data, and controls the actions of the various components of the image-forming apparatus 2*a*. The CPU 50*a*, while using an unrepresented ROM (Read Only Memory) and RAM (Random Access Memory) as work memories, reads out various types of programs such as system software and/or the like stored in the ROM and the memory apparatus 57*a* and executes appropriately.

The LAN communicator 51*a* and the USB communicator 52*a* communicate with external equipment including the terminal apparatus 60, the paper supply apparatus 1*a* and the winding apparatus 9 via the LAN and USB, respectively.

The panel controller 53*a* is connected to the operation panel 54*a* comprising for example a display panel such as an LCD (Liquid Crystal Display) and/or the like and an input apparatus including various types of operation buttons. The panel controller 53*a*, under control of the CPU 50*a*, displays images and text and/or the like on the operation panel 54*a* and receives operations from a user input into the operation panel 54*a*.

The command analyzer 55*a*, under control of the CPU 50*a*, analyzes commands included in print data sent from the terminal apparatus 60 and converts the print data into bitmap image data. The command analyzer 55*a* develops the converted bitmap image data in a memory area corresponding to frame memory for each color of toner with which the image-forming apparatus 2*a* is equipped. The image data developed in the frame memory is output to the print controller 58*a*.

The memory apparatus 57*a* is non-volatile memory such as an EEPROM (Electrically Erasable Programmable ROM), HDD (Hard Disk Drive) and/or the like. The memory apparatus controller 56*a*, under control of the CPU 50*a*, controls writing of data to the memory apparatus 57*a* and reading of data stored in the memory apparatus 57*a*.

The print controller 58*a*, under control of the CPU 50*a*, controls the printing mechanism including the image-forming unit 20*a*, the intermediate transfer belt unit 30*a* and the fuser apparatus 40*a*, and accomplishes a printing process in accordance with image data generated by the command analyzer 55*a*.

The image-forming apparatus 2*b* comprises a CPU 50*b*, a LAN communicator 51*b*, a USB communicator 52*b*, a panel controller 53*b*, an operation panel 54*b*, a command analyzer 55*b*, a memory apparatus controller 56*b*, a memory apparatus 57*b* and a printing controller 58*b*. The image-forming apparatus 2*b* has a composition relating to control the same as the image-forming apparatus 2*a*, so detailed description is omitted.

The terminal apparatus 60 is for example an information processing apparatus such as a PC (Personal Computer) and/or the like, and is connected to the two image-forming apparatuses 2*a* and 2*b* via the LAN and the USB. The terminal apparatus 60 comprises a controller 61, a communicator 62, an operation unit 63, a display unit 64 and a memory unit 65.

The controller 61 comprises for example a CPU and RAM and/or the like that functions as a main memory of the CPU. The controller 61 is connected to each component of the terminal apparatus 60 via a system bus that is a transmission route for transmitting commands and data, and controls the terminal apparatus 60 as a whole.

The communicator 62, under control of the controller 61, communicates with the two image-forming apparatuses 2*a* and 2*b* via the USB or the LAN.

The operation unit 63 comprises an input apparatus such as a mouse, keyboard and/or the like. The operation unit 63 receives operations from a user. For example, the operation unit 63 supplies to the controller 61 a signal for setting print conditions or a signal for executing printing.

The display unit 64 comprises for example a display device such as a CRT (Cathode Ray Tube), an LCD and/or the like. The display unit 64 displays on a screen images based on image data supplied from the controller 61.

The memory unit 65 comprises for example a memory apparatus such as an HDD, ROM, flash memory and/or the like. The memory unit 65 stores programs and data the controller 61 uses for executing various types of processes, including printer drivers for printing in multiple colors using the two image-forming apparatuses 2*a* and 2*b*.

Figure 5A:
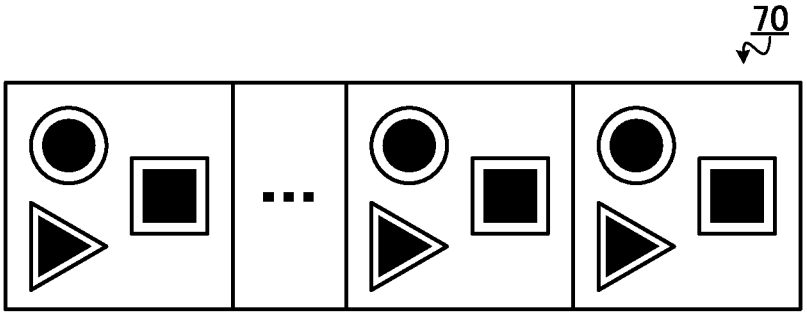
FIG. 5A is a drawing showing an example of image data of a printing target.

As shown in FIG. 5A as an example, the description is for a case in which image data 70 of multiple labels with the various labels comprising the figures of a square, a circle and a triangle are printed to the roll paper 3 from the terminal apparatus 60 using the printing system 100.

When a user operates the operation unit 63 and accomplishes a print command for image data 70 of a printing target via a prescribed application, the controller 61 generates image data for the normal color printing system 10*a* and image data for the special color printing system 10*b* in accordance with the printer driver stored in the memory unit 65.

Figure 5B:
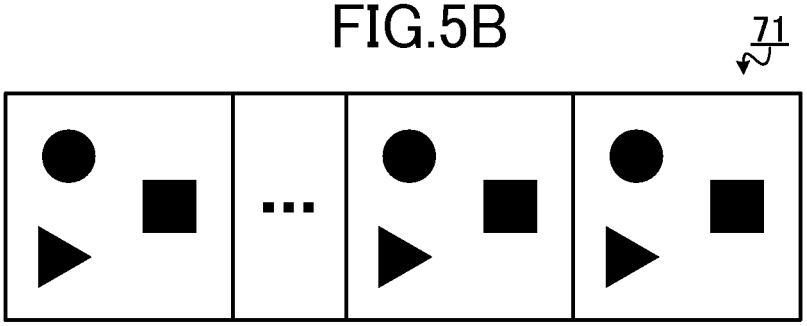
FIG. 5B is a drawing showing an example of normal color image data.

To explain more specifically, the controller 61 extracts image data that should be output with black (K) toner from the image data 70 of the printing target as image data for the normal color printing system 10*a*, and generates normal color image data 71 for example as shown in FIG. 5B. When color printing is commanded, the controller 61 further generates the image data that should be output with toner of the colors YMC as image data for the normal color printing system 10*a*.

Figure 5C:
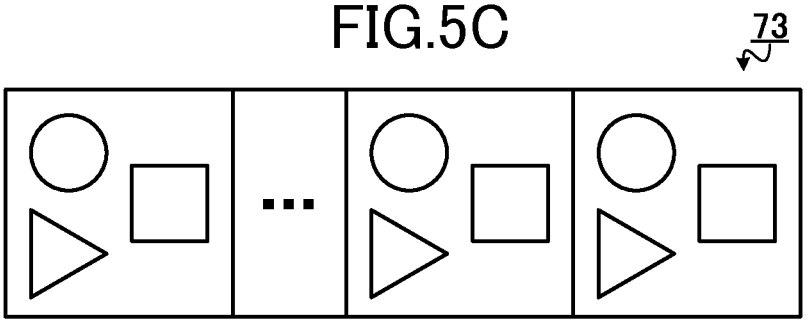
FIG. 5C is a drawing showing an example of special color image data.

In addition, the controller 61 extracts image data that should be output with special colors of toner from the image data 70 of the printing target, as image data for the special color printing system 10*b*, and generates special color image data 73 for example as shown in FIG. 5C. When printing using multiple types of special colors is commanded, the controller 61 generates the multiple items of image data commanded as image data for the special color printing system 10*b*.

The controller 61 sends first print data including the generated normal color image data 71 and print conditions to the image-forming apparatus 2*a* via the communicator 62. In addition, the controller 61 sends second print data including the generated special color image data 73 and print conditions to the image-forming apparatus 2*b* via the communicator 62. The print conditions are setting conditions relating to image formation such as resolution and gradation value, and other printing setting conditions such as the size and type of roll paper 3 and printing range.

Figure 6:
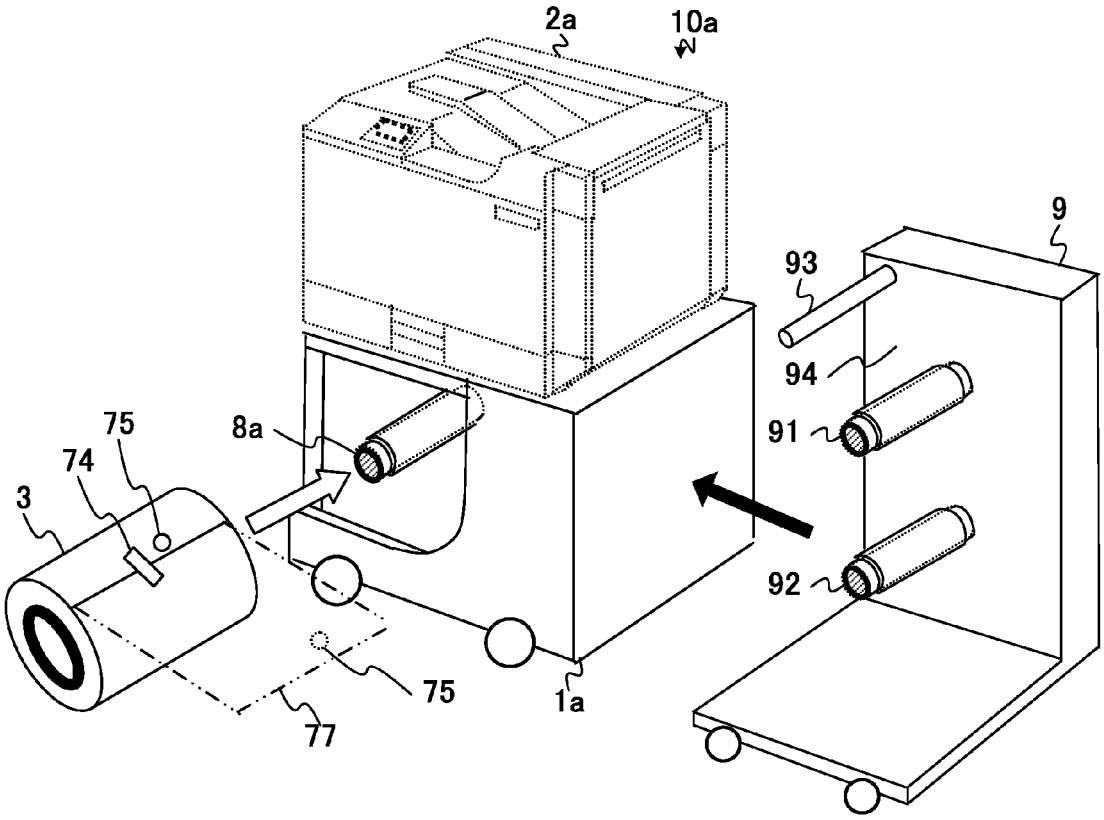
FIG. 6 is a drawing showing a state preparing for printing in the printing system.

When the first and second print data are sent, the printing process in the printing system 100 starts. Prior to the start of printing, the user attaches the roll paper 3 prior to printing with a beginning edge 77 anchored by anchor-tape 74 to the holder 8*a* of the paper supply apparatus 1*a*, for example as shown in FIG. 6. Furthermore, the user causes the winding apparatus 9 to move and mounts such on the normal color printing system 10*a*, and makes preparations for winding the roll paper 3 the image-forming apparatus 2*a* discharges.

In a state in which printing preparations are thus concluded, when the first and second print data are sent from the terminal apparatus 60, the paper supply apparatuses 1*a* and 1*b* and the winding apparatus 9 are driven and printing starts. The composition relating to control of the paper supply apparatuses 1*a* and 1*b* and the winding apparatus 9 is described with reference to FIG. 7.

A controller 81*a* with which the paper supply apparatus 1*a* is equipped controls the actions of the paper supply apparatus 1*a* as a whole through the functions of an unrepresented CPU, RAM, ROM and/or the like. Specifically, the controller 81*a* functions as an unwinder 82*a*, conveyor 83*a* and detector 84*a*.

The unwinder 82*a* functions as a first unwinder and unwinds the roll paper 3 held by the holder 8*a*. That is to say, when a paper supply request is received from the image-forming apparatus 2*a* that has received the first print data, the unwinder 82*a* causes the rotation shaft of the holder 8*a* to rotate and unwinds the roll paper 3 installed on the holder 8*a* in order from the beginning edge 77. The conveyor 83*a* causes the paired conveyor roller 13*a* and the paired feed roller 16*a* to be driven and successively conveys to the image-forming apparatus 2*a* the roll paper 3 unwound by the unwinder 82*a*.

An original mark 75 is recorded in advance on the roll paper 3. The original mark 75 functions as a reference mark that is a position reference when the image-forming apparatus 2*a* forms images on the roll paper 3. The detector 84*a* functions as a first detector and detects by means of the mark sensor 15*a* the original mark 75 recorded on the roll paper 3 conveyed by the conveyor 83*a* after being unwound by the unwinder 82*a*.

Figure 8A:
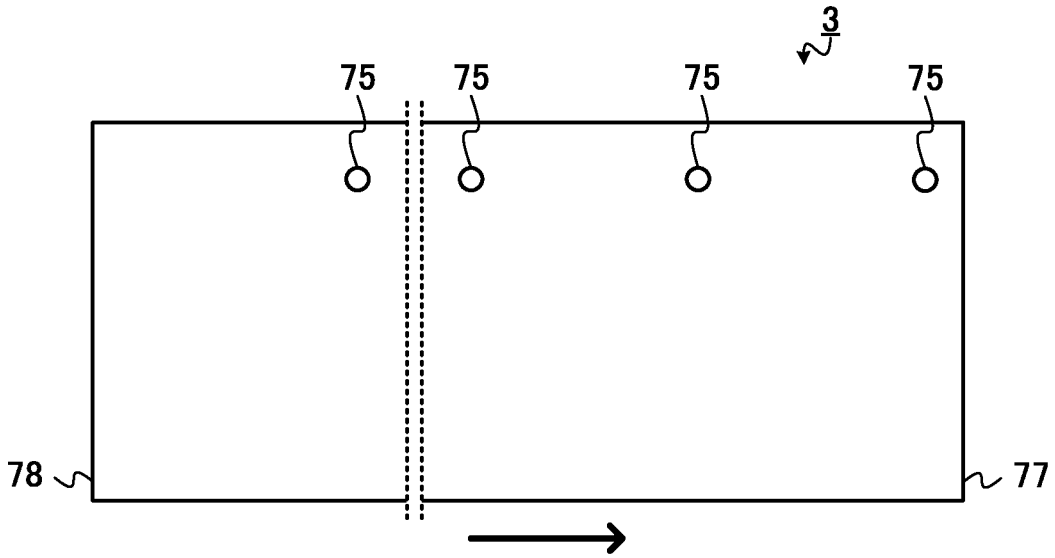
FIG. 8A is a drawing showing roll paper supplied from the first paper supply apparatus.

For example, as shown in FIG. 8A, the original mark 75 is recorded at fixed intervals at multiple positions from the beginning edge 77 to a ending edge 78 of the roll paper 3. The intervals are set to a length corresponding to the pitch of the labels in the image data 70 to be output, so that the image-forming apparatus 2*a* can adjust the position of image formation for each label. To facilitate understanding, FIG. 8A shows a state with the entirety of the roll paper 3 unwound and spread out. In addition, an arrow indicates the conveyance direction of the roll paper 3. The same is true in below-described FIG. 8B, FIG. 12A and FIG. 12B.

Figure 8B:
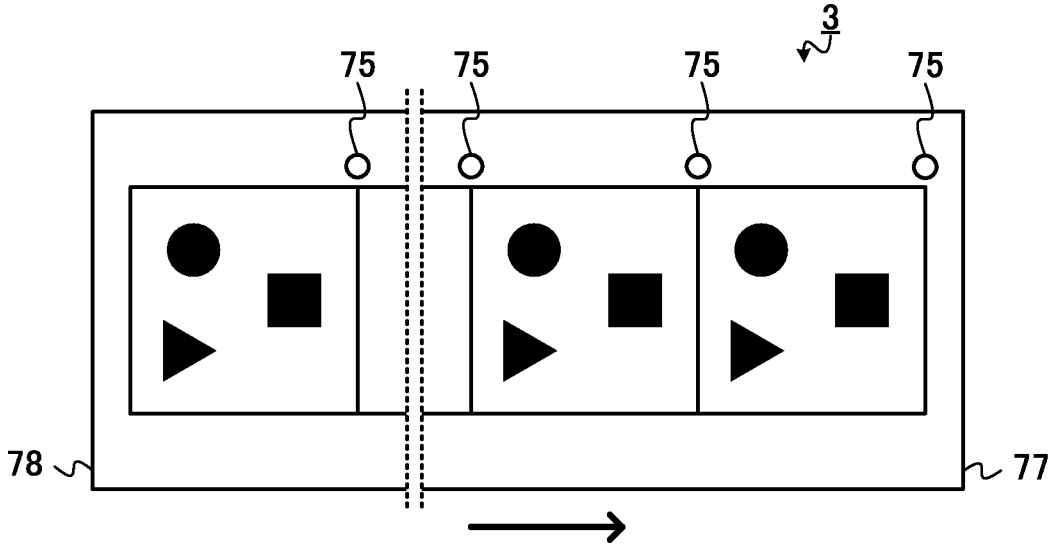
FIG. 8B is a drawing showing roll paper after image formation by the first image-forming apparatus.

The image-forming apparatus 2*a* forms (develops) a first toner image of toner in the four colors of YMCK and forms (transfers, and fixes) the first toner image on the roll paper 3 conveyed by the conveyor 83*a*, based on the normal color image data 71 sent from the terminal apparatus 60. At this time, the image-forming apparatus 2*a* forms the first toner image on the roll paper 3 with the original mark 75 detected by the detector 84*a* as the position reference, so that the region in which the first toner image is formed does not shift up-and-down or left-and-right. As a result, an output image for multiple labels for example as shown in FIG. 8B is output to the roll paper 3. The roll paper 3 on which the first toner image is recorded is fixed by the fuser apparatus 40*a* and is discharged to the winding apparatus 9.

Figure 7:
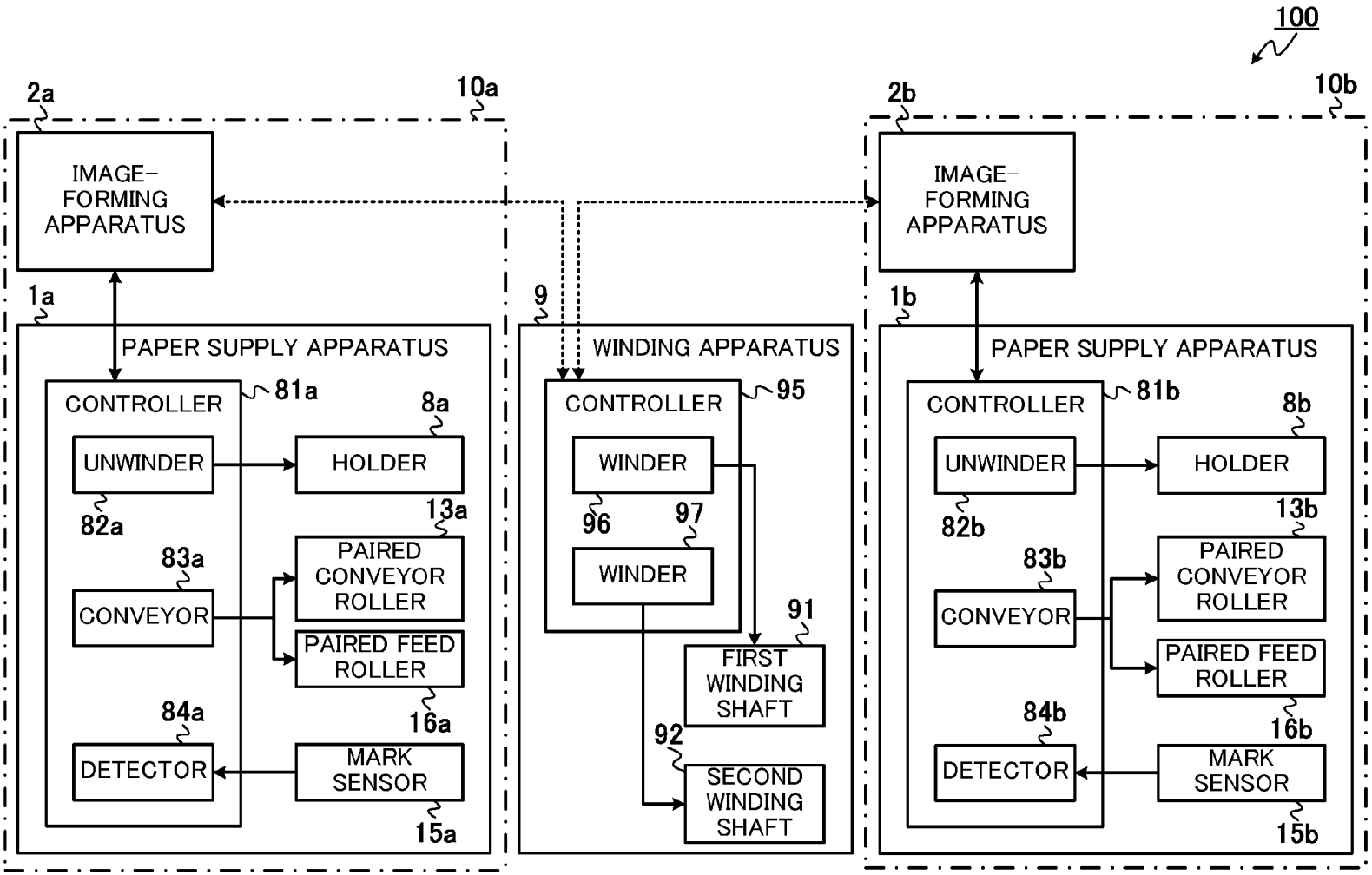
FIG. 7 is a block diagram showing a composition relating to control of a first paper supply apparatus, a second paper supply apparatus and a winding apparatus.

Returning to the explanation of FIG. 7, a controller 95 with which the winding apparatus 9 is equipped controls the actions of the winding apparatus 9 as a whole through the functions of an unrepresented CPU, RAM, ROM and/or the like.

A winder 96 functions as a first winder and winds the first roll paper 3 on which the image-forming apparatus 2*a* printed (developed, transferred and fixed) the first toner image based on the normal color image data 71 around the first winding shaft 91 in order from the beginning edge 77 to the ending edge 78 of the roll paper 3. For example as shown in FIG. 9A and FIG. 9B, the winder 96, upon receiving a winding request for the roll paper 3 from the image-forming apparatus 2*a*, causes the first winding shaft 91 to rotate and starts winding the roll paper 3 discharged from the image-forming apparatus in order from the beginning edge 77 to the ending edge 78.

Figure 10A:
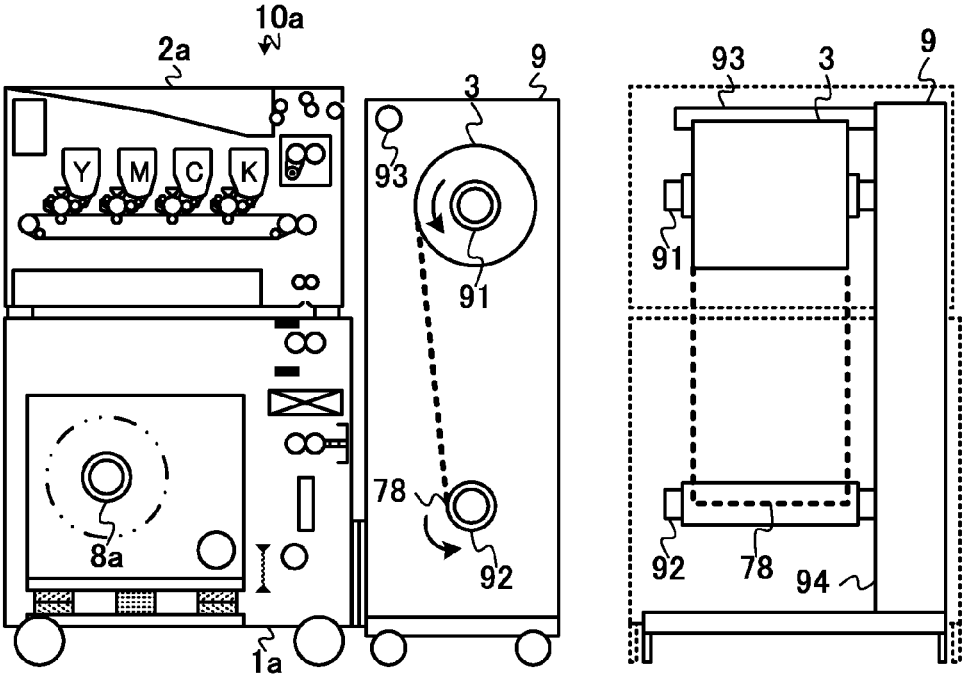
FIGS. 10A and 10B are a front view and a side view showing the state when the winding apparatus accomplishes a second winding.

When the first winding concludes, the roll paper 3 is in a state wound with the beginning edge 77 on the inside and the ending edge 78 on the outside, and is held on the first winding shaft 91. From this state, the user anchors the ending edge 78 of the roll paper 3 to the second winding shaft 92 as shown in FIG. 10A, and prepares for the second winding (re-winding). At this time, for the paper tube mounted on the second winding shaft 92, it is possible to reuse the paper tube used by the holder 8*a* of the paper supply apparatus 1*a* in the normal color printing system 10*a*.

When preparation for the second winding concludes, the winder 97 starts re-winding the roll paper 3 by causing the second winding shaft 92 to rotate. That is to say, the winder 97 functions as a second winder, rewinds the roll paper 3 that the winder 96 wound around the winding shaft 91, and winds the rewound roll paper 3 around the second winding shaft 92 in order from the ending edge 78 to the beginning edge 77 of the roll paper 3.

Figure 9A:
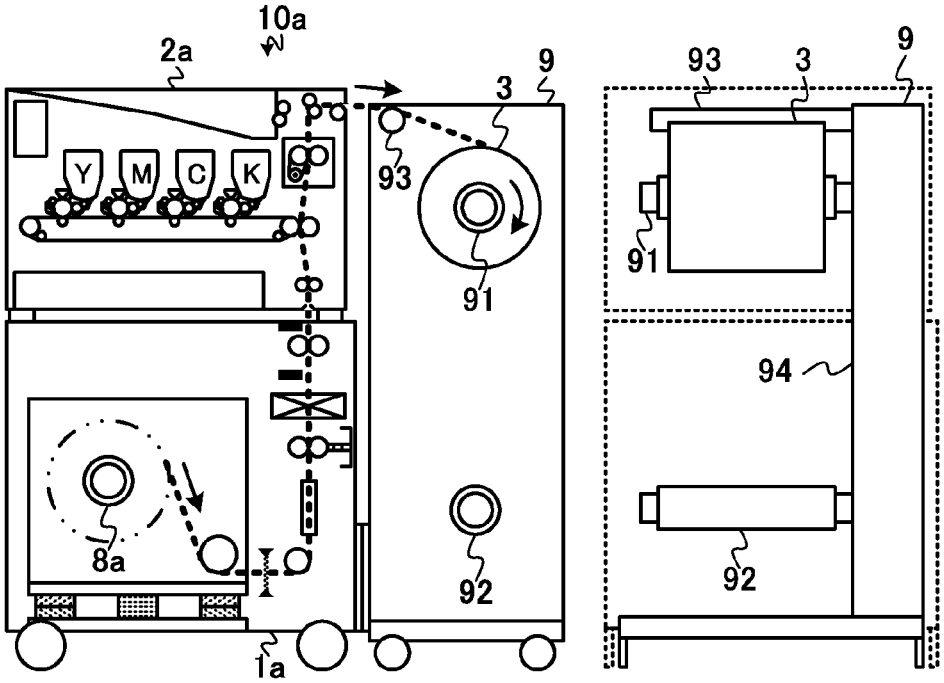
FIG. 9A is a front view and a side view showing the state when the winding apparatus accomplishing a first winding.
Figure 9B:
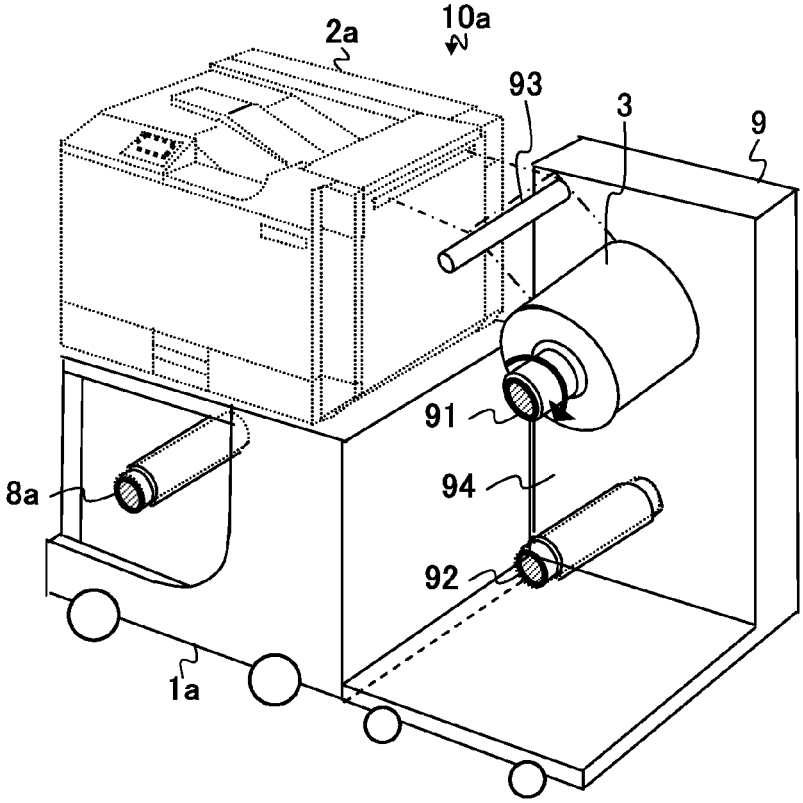
FIG. 9B is an oblique view showing the state when the winding apparatus accomplishes the first winding.

During winding to the second winding shaft 92, the first winding shaft 91 follows the roll paper 3 unwound by rotational driving of the second winding shaft 92, and rotates in the opposite direction (the direction of the arrow in FIG. 10A) from the direction during winding to the first winding shaft 91 (the direction of the arrow in FIG. 9A). Consequently, the first winding shaft 91 is provided for example with a one-directional clutch, and is comprised so as to rotate in a first direction upon receiving driving power of the motor during the first winding and spins upon receiving torque in the opposite direction from the first direction when receiving driving power of the second winding shaft 92 during the second winding.

Figure 10B:
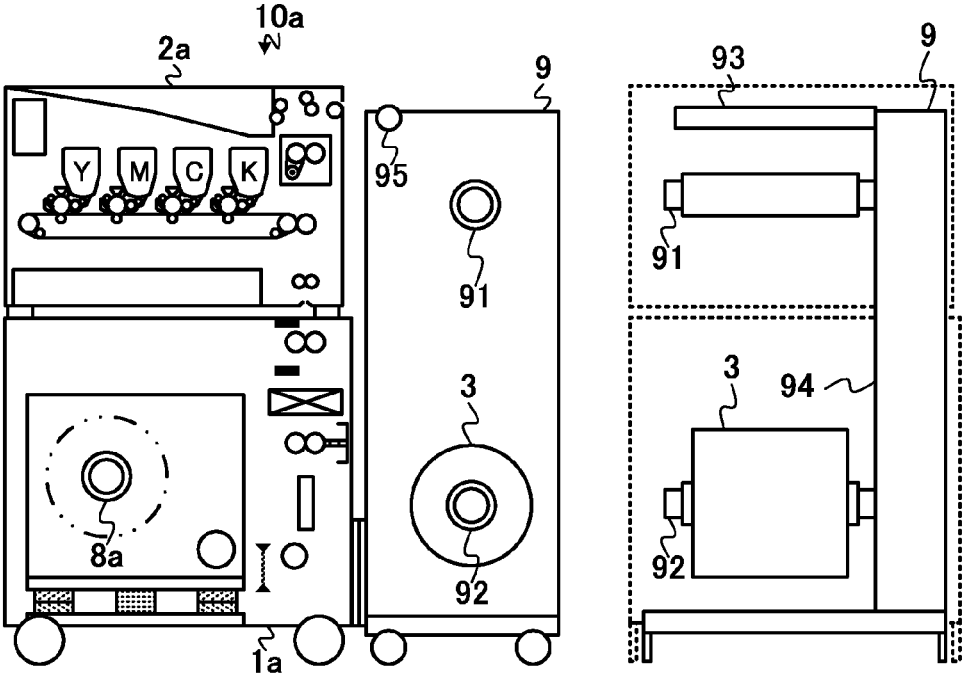

When the second winding concludes as shown in FIG. 10B, the roll paper 3 is held on the second winding shaft 92 in a state wound with the beginning edge 77 on the outside and the ending edge 78 on the inside. The beginning edge 77 of the roll paper 3 that has finished winding is temporarily anchored by anchor-tape 74.

Figure 11:
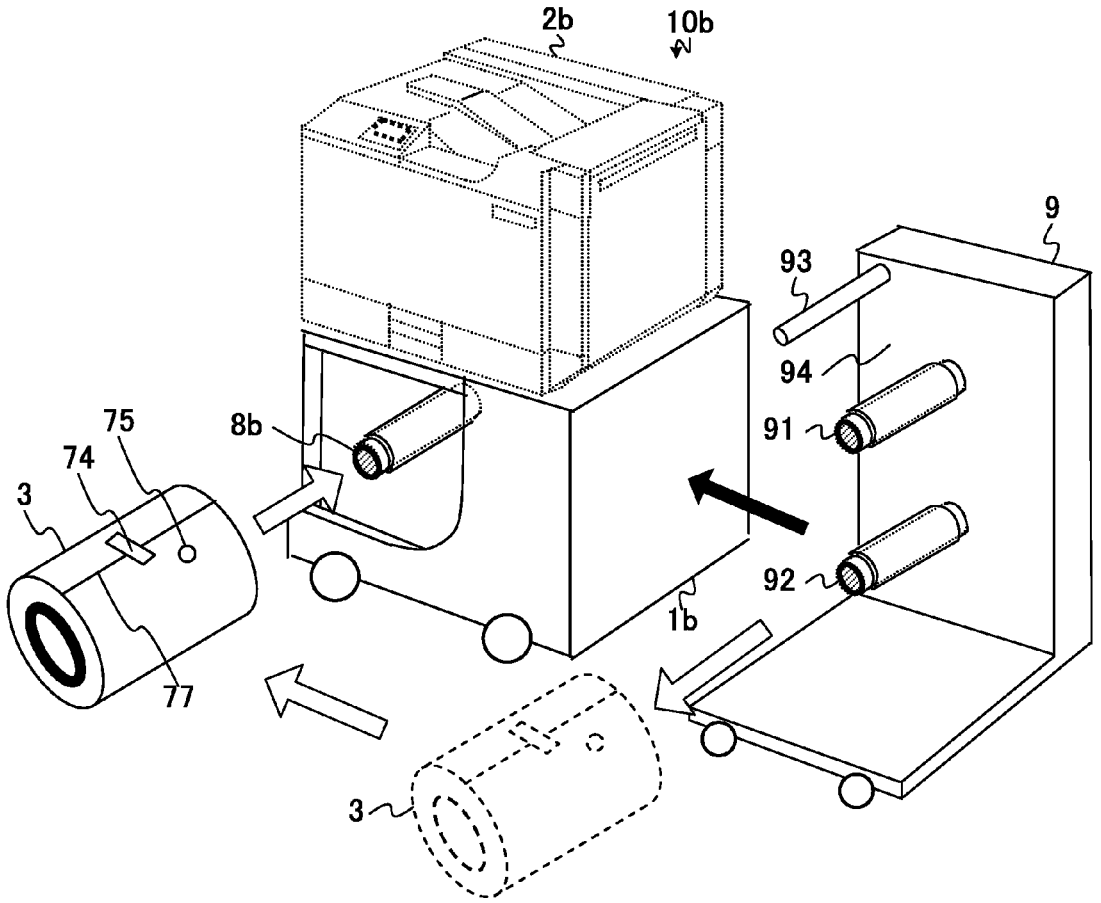
FIG. 11 is a drawing showing the state when the roll paper wound by the winding apparatus is attached to the holder of the second paper supply apparatus.

When winding by the winding apparatus 9 ends, as shown in FIG. 11 the user removes the roll paper 3 from the second winding shaft 92 in order to accomplish additional printing with special colors, and mounts the roll paper 3 on the holder 8*b* of the paper supply apparatus 1*b* of the special color printing system 10*b*. Furthermore, the user causes the winding apparatus 9 to move and mounts such on the special color printing system 10*b*, and prepares for winding of the roll paper 3 to be discharged by the image-forming apparatus 2*b*. The roll paper that has finished being wound by the winding apparatus 9 is in a state wound with the beginning edge 77 to the outside and the ending edge 78 on the inside, the same as prior to the start of printing, so mounting on the paper supply apparatus 1*b* of the special color printing system 10*b* in the same direction as the roll paper 3 mounted on the paper supply apparatus 1*a* of the normal color printing system 10*a* is possible.

Returning to FIG. 7, the composition relating to control of the special color printing system 10*b* is described. The controller 81*b* with which the paper supply apparatus 1*b* is equipped controls the actions of the paper supply apparatus 1*b* as a whole through the functions of an unrepresented CPU, RAM, ROM and/or the like. Specifically, the controller 81*b* functions as an unwinder 82*b*, a conveyor 83*b* and a detector 84*b*.

Figure 12A:
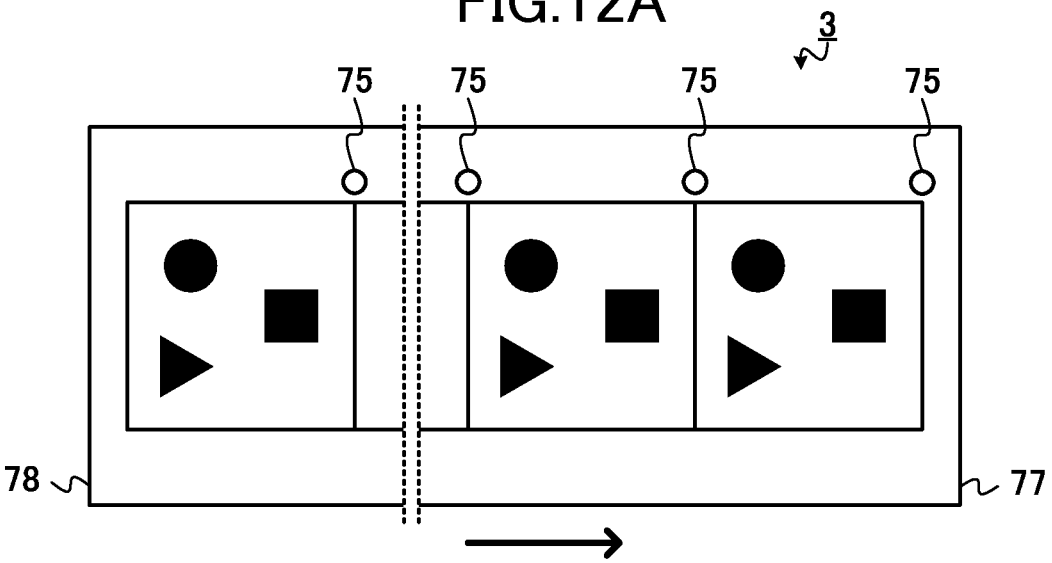
FIG. 12A is a drawing showing the roll paper supplied from the second paper supply apparatus.

The unwinder 82*b* functions as a second unwinder, causes the rotation shaft of the holder 8*b* to rotate and unwinds the roll paper 3 attached to the holder 8*b* in order from the beginning edge 77 to the ending edge 78 of the roll paper 3. The conveyor 83*b* drives the paired conveyor roller 13*b* and the paired feed roller 16*b* and/or the like and successively conveys the roll paper 3 unwound by the unwinder 82*b* to the image-forming apparatus 2*b*. Specifically, as shown in FIG. 12A, the conveyor 83*b* conveys the roll paper 3 on which toner images in the normal colors (the four colors of YMCK) were formed with the beginning edge 77 in the lead.

The detector 84*b* functions as a second detector and detects, through the mark sensor 15*b*, the original mark 75 recorded on the roll paper 3 unwound by the unwinder 82*b* and conveyed by the conveyor 83*b*.

The image-forming apparatus 2*b* forms a second toner image through toner of special colors not included in YMCK, based on the special color image data 73 sent from the terminal apparatus 60. To explain specifically, the image-forming apparatus 2*b* forms two white toner images by means of the two Image-forming parts 21*w*1 and 21*w*2 that form images through white toner, and forms toner images in other special colors by means of the Image-forming parts 21*s*1 and 21*s*2 that form images through other special colors. Furthermore, by superimposing the two white toner images formed and the other special color toner images, a second toner image is formed. Furthermore, the second toner image is formed at the region (surface) in which the first toner image of the roll paper 3 conveyed by the conveyor 83*b* was formed.

Figure 12B:
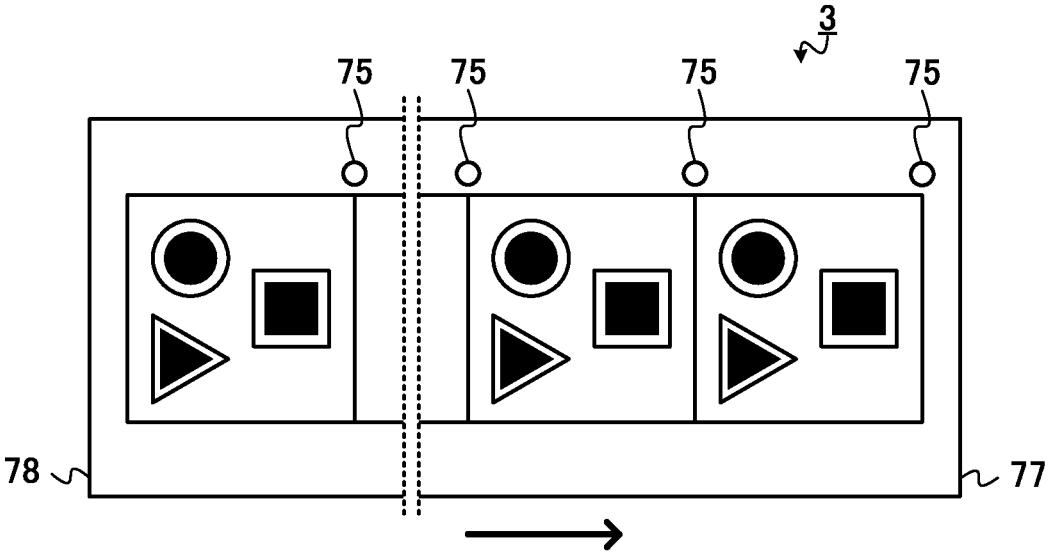
FIG. 12B is a drawing showing the roll paper after image formation by the second image-forming apparatus.

At this time, the image-forming apparatus 2*b* forms the second toner image on the roll paper with the original mark 75 detected by the detector 84*b* as a position reference so that the region where the second toner image is formed does not shift to the front or back, or to the left or right. As a result, output images of multiple labels that reproduced the image data 70 of the printing target are output to the roll paper 3, as shown in FIG. 12B. The roll paper 3 on which the second toner image is formed is fixed by the fuser apparatus 40*b* and discharged to the winding apparatus 9.

In the winding apparatus 9, the winder 96 winds the roll paper 3 discharged from the image-forming apparatus 2*b* around the first winding shaft 91 in order from the beginning edge 77 to the ending edge 78. Furthermore, the winder 97 unwinds the roll paper 3 wound around the first winding shaft 91 and winds the roll paper 3 around the second winding shaft 92 in order from the ending edge 78 to the beginning edge 77. As a result, the roll paper 3 on which the desired multi-color ink printing was done obtains a wound state with the beginning edge 77 on the outside and the ending edge 78 on the inside, the same as prior to the start of printing.

The flow of multi-color printing processes in the above kind of printing system 100 is explained with reference to the flowcharts shown in FIGS. 13-15.

The multi-color printing processes of the printing system 100 start in a state in which the roll paper 3 prior to printing is attached to the paper supply apparatus 1*a* in the normal color printing system 10*a* and the winding apparatus 9 is mounted, that is to say in a state in which printing preparations have concluded.

Figure 13:
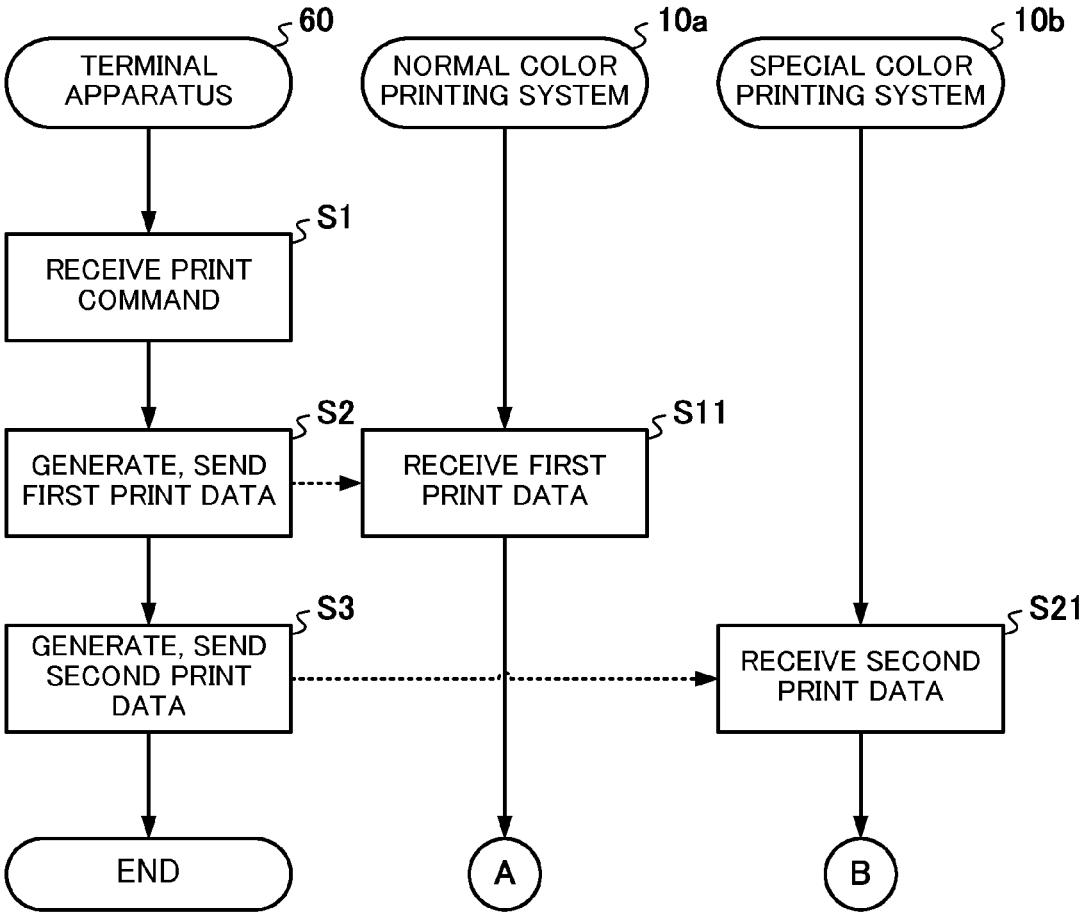
FIG. 13 is a first flowchart showing the flow of processes executed in the printing system according to the first exemplary embodiment.

In the terminal apparatus 60, the controller 61, upon receiving a print command from the user via the operation unit 63 for example (step S1), starts the process in the flowchart shown in FIG. 13.

When the print command is received, the controller 61 generates first print data in accordance with the print command and sends the generated first print data to the image-forming apparatus 2*a* of the normal color printing system 10*a* (step S2). The first print data includes image data that should be output with the four colors of YMCK in the image data 70 of the printing target, and print conditions, as in the normal color image data 71 shown in FIG. 5B for example.

Along with generating and sending the first print data, the controller 61 generates second print data in accordance with the print command and sends the generated second print data to the image-forming apparatus 2*b* of the special color printing system 10*b* (step S3). The second print data includes image data that should be output in special colors other than YMCK in the image data 70 of the printing target, and print conditions, as in the special color image data 73 shown in FIG. 5C for example.

In the normal color printing system 10*a*, the image-forming apparatus 2*a* receives the first print data sent from the terminal apparatus 60 via the LAN communicator 51*a* or the USB communicator 52*a* (step S11). In the special color printing system 10*b*, the image-forming apparatus 2*b* receives the second print data sent from the terminal apparatus 60 via the LAN communicator 51*b* or the USB communicator 52*b* (step S21). Subsequent processes are explained with reference to the flowchart shown in FIG. 14.

In the normal color printing system 10*a*, upon receiving the first print data from the terminal apparatus 60, the image-forming apparatus 2*a* sends a paper supply request to the paper supply apparatus 1*a*, sends a winding request to the winding apparatus 9, and begins unwinding, conveying and winding the roll paper 3 (step S12). In the paper supply apparatus 1*a* that has received the paper supply request, the unwinder 82*a* unwinds the roll paper 3 held by the holder 8*a* in order from the beginning edge 77 to the ending edge 78 and supplies the roll paper 3 to the image-forming apparatus 2*a* via conveyance by the conveyor 83*a*.

When winding and conveying of the roll paper 3 begins, the detector 84*a* detects the original mark 75 recorded in advance on the roll paper 3 that is conveyed (step S13). Then, the image-forming apparatus 2*a* accomplishes image formation with normal colors (YMCK) on the conveyed roll paper 3 with the position of the detected original mark 75 as a reference (step S14).

While forming images in this manner, the image-forming apparatus 2*a* determines whether or not the commanded image formation has finished (step S15). When the commanded image formation has not finished (step S15: No), the process returns to step S13. That is to say, the normal color printing system 10*a* repeats the processes of steps S13-S14 and continues image formation until the commanded image formation concludes.

When the commanded image formation finishes (step S15: Yes), the image formation apparatus 2*a* sends a paper supply stop request to the paper supply apparatus 1*a*, sends a winding stop request to the winding apparatus 9 and causes unwinding, conveyance and winding of the roll paper 3 to stop (step S16). Then, printing in the normal color printing system 10*a* finishes.

The winding process of the winding apparatus 9 is described with reference to the flowchart shown in FIG. 15. In the winding apparatus 9, when a winding request is received from the image-forming apparatus 2*a* (step S31), the winder 96 causes the first winding shaft 91 to rotate and winds the roll paper 3 on which the image-forming apparatus 2*a* accomplished image formation with the first toner in normal colors (YMCK) onto the first winding shaft 91 in order from the beginning edge 77 to the ending edge 78 (step S32).

During winding to the first winding shaft 91, the winder 96 determines whether or not winding has finished (step S33) and until winding finishes (step S33: No), successively winds the roll paper 3 discharged from the image-forming apparatus 2*a* around the first winding shaft 91. When a winding stop request is received from the image-forming apparatus 2*a*, the winder 96 halts rotation of the first winding shaft 91 and finishes winding (step S33: Yes).

When winding to the first winding shaft 91 concludes, the user prepares for the second winding (re-winding) by anchoring the ending edge 78 of the roll paper 3 wound on the first winding shaft 91 to the second winding shaft 92, as shown in FIG. 10A. When preparation for re-winding is completed, the user commands re-winding via an unrepresented operation unit with which the winding apparatus 9 is equipped.

When a re-winding command is received (step S34), the winder 97 causes the second winding shaft 92 to rotate and winds the roll paper 3 unwound from the first winding shaft 91 to the second winding shaft 92 in order from the ending edge 78 to the beginning edge 77 (step S35).

During winding to the second winding shaft 92, the winder 97 determines whether or not re-winding has finished (step S36), and until re-winding finishes (step S36: No), successively winds the roll paper 3 unwound from the first winding shaft 91 around the second winding shaft 92. When winding of the roll paper 3 to the beginning edge 77 ends, the winder 97 halts rotation of the second winding shaft 92, and finishes re-winding (step S36: Yes). Then, the winding process in the winding apparatus 9 finishes.

Figure 14:
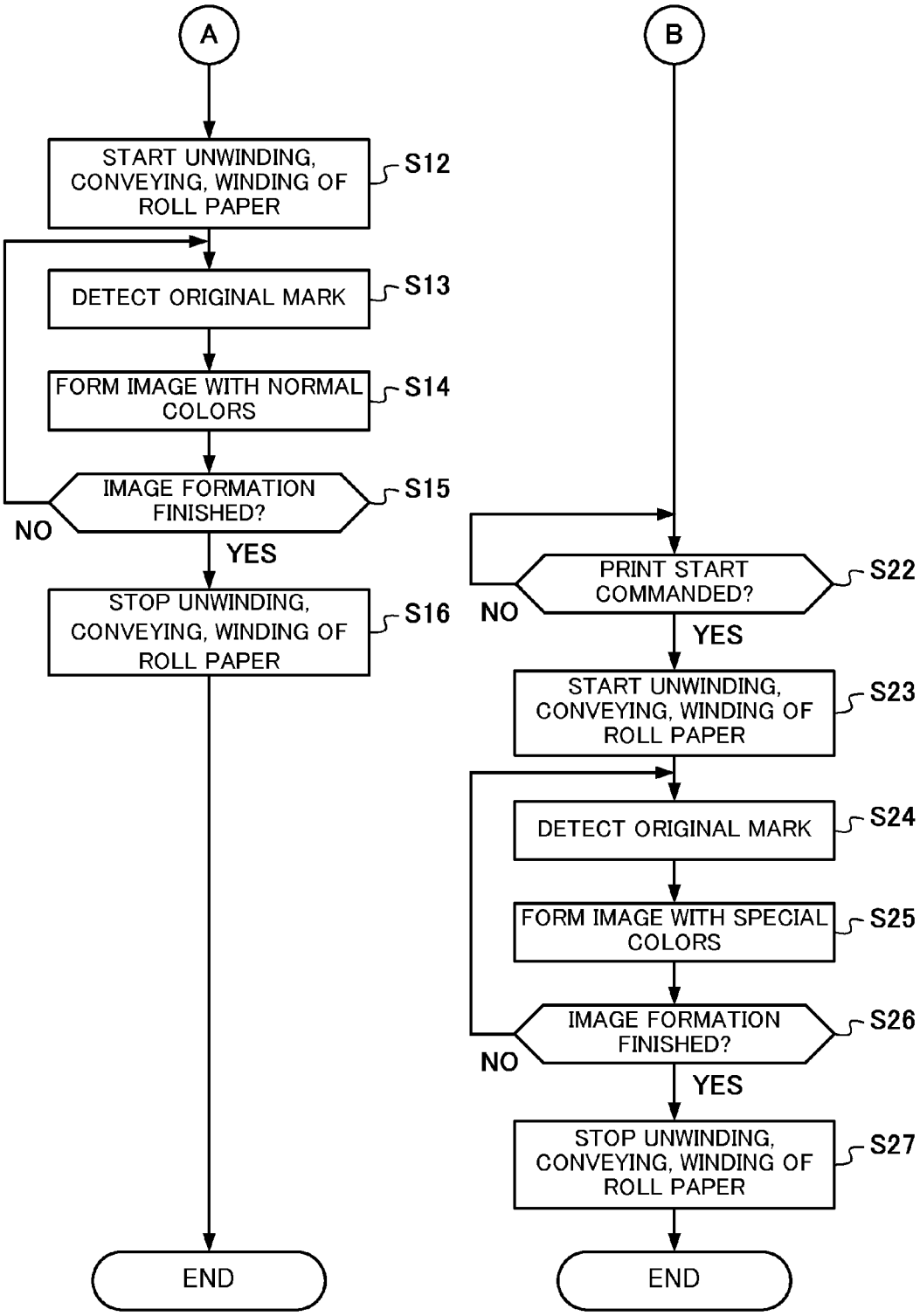
FIG. 14 is a second flowchart showing the flow of processes executed in the printing system according to the first exemplary embodiment.
Figure 15:
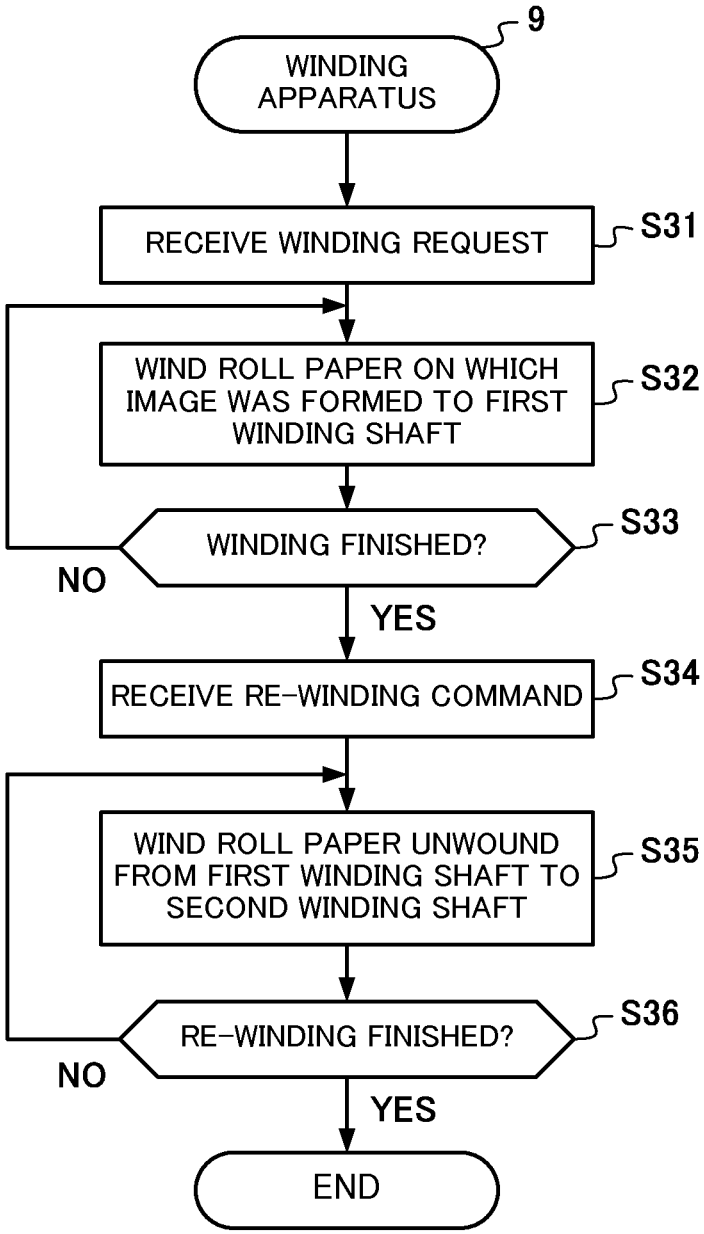
FIG. 15 is a flowchart showing the flow of processes executed in the winding apparatus.

Returning to the explanation of the flowchart shown in FIG. 14, when printing in the normal color printing system 10*a* and winding by the winding apparatus 9 conclude, the roll paper 3 wound by the winding apparatus 9 is removed from the second winding shaft 92 as shown in FIG. 11 and attached to the paper supply apparatus 1*b* of the special color printing system 10*b*. In addition, the winding apparatus 9 is mounted on the special color printing system 10*b*. When this kind of printing preparation is completed, the user inputs a command for printing with special colors via an operation panel 54*b* of the image-forming apparatus 2*b*, for example, and printing in the special color printing system 10*b* begins.

That is to say, during printing by the normal color printing system 10*a* and winding by the winding apparatus 9, the image-forming apparatus 2*b* that has received the second print data from the terminal apparatus 90 in the special color printing system 10*b* determines whether or not the start of printing has been commanded (step S22), and while the start of printing has not been commanded (step S22: No), waits.

When the start of printing is commanded (step S22: Yes), the image-forming apparatus 2*b* sends a paper supply request to the paper supply apparatus 1*b*, sends a winding request to the winding apparatus 9 and starts unwinding, conveying and winding of the roll paper 3 (step S23). In the paper supply apparatus 1*b* that has received the paper supply request, the unwinder 82*b* unwinds the roll paper 3 held on the holder 8*b* in order from the beginning edge 77 to the ending edge 78, and supplies the roll paper 3 to the image-forming apparatus 2*b* via conveyance by the conveyor 83*b*.

When winding and conveying of the roll paper 3 begins, the detector 84*b* detects the original mark 75 recorded on the conveyed roll paper 3 (step S24). Then, the image-forming apparatus 2*b* accomplishes image formation with special colors on the conveyed roll paper 3 with the position of the detected original mark 75 as a reference (step S25). In the winding apparatus 9 that has received a winding request, the winder 96 successively winds the roll paper 3 on which images have been formed.

During this kind of image formation the image-forming apparatus 2*b* determines whether or not the commanded image formation has finished (step S26), and when the commanded image formation has not finished (step S26: No), the process returns to step S24. That is to say, the special color printing system repeats the processes of steps S24-S25 and continues image formation until the commanded image formation concludes, When the commanded image formation finishes (step S26: Yes), the image-forming apparatus 2*b* sends a paper supply stop request to the paper supply apparatus 1*b*, sends a winding stop request to the winding apparatus 9 and stops unwinding, conveying and winding of the roll paper 3 (step S27). Then, printing in the special color printing system 10*b* and the printing system 100 concludes.

As described above, the printing system 100 according to the first exemplary embodiment realizes multi-color printing with toner in a maximum of eight colors by successively forming images using the two image-forming apparatuses 2*a* and 2*b* corresponding to four-color color printing. Because printing with other colors of developing agents in addition to the typical four colors of YMCK is possible, it is possible to form white toner images with two layers superimposed by the two Image-forming parts 21*w*1 and 21*w*2 forming images with white toner, for example, and it is possible to obtain a sufficient degree of white color even when a white toner image is formed in a deep base area. In addition, because it is fine to prepare two image-forming apparatuses corresponding to four-color color printing having the same hardware composition, it is not necessary to prepare a large special apparatus corresponding to color printing with five or more colors.

In addition, the printing system 100 according to the first exemplary embodiment, after image formation in the first image-forming apparatus 2*a*, forms an image with the second image-forming apparatus 2*b* on the roll paper 3 on which fixing by the fuser apparatus 40*a* has already been completed. Consequently, the layer depth of the developing agent to be fixed by the fuser apparatus does not become too thick and it is possible to prevent deterioration of fixing precision.

Furthermore, in the winding apparatus 9, after the first winding shaft 91 has wound the roll paper 3 on which an image was formed by the image-forming apparatus 2*a*, the second winding shaft 92 rewinds and again winds the roll paper 3 wound around the first winding shaft 91. As a result, the two image-forming apparatuses 2*a* and 2*b* both form images on the roll paper 3 unwound in order from the beginning edge 77, so image formation is possible with the same original mark 75 recorded on the roll paper 3 as a position reference. In addition, in the second image formation, a complex process such as causing the image to reverse up and down or left and right is unnecessary while forming the special color print data 73, so it is possible to realize multi-color printing using the two image-forming apparatuses 2*a* and 2*b* with a simple composition.

Second Exemplary Embodiment

Below, a printing system according to a second exemplary embodiment of the present disclosure is described.

Figure 16:
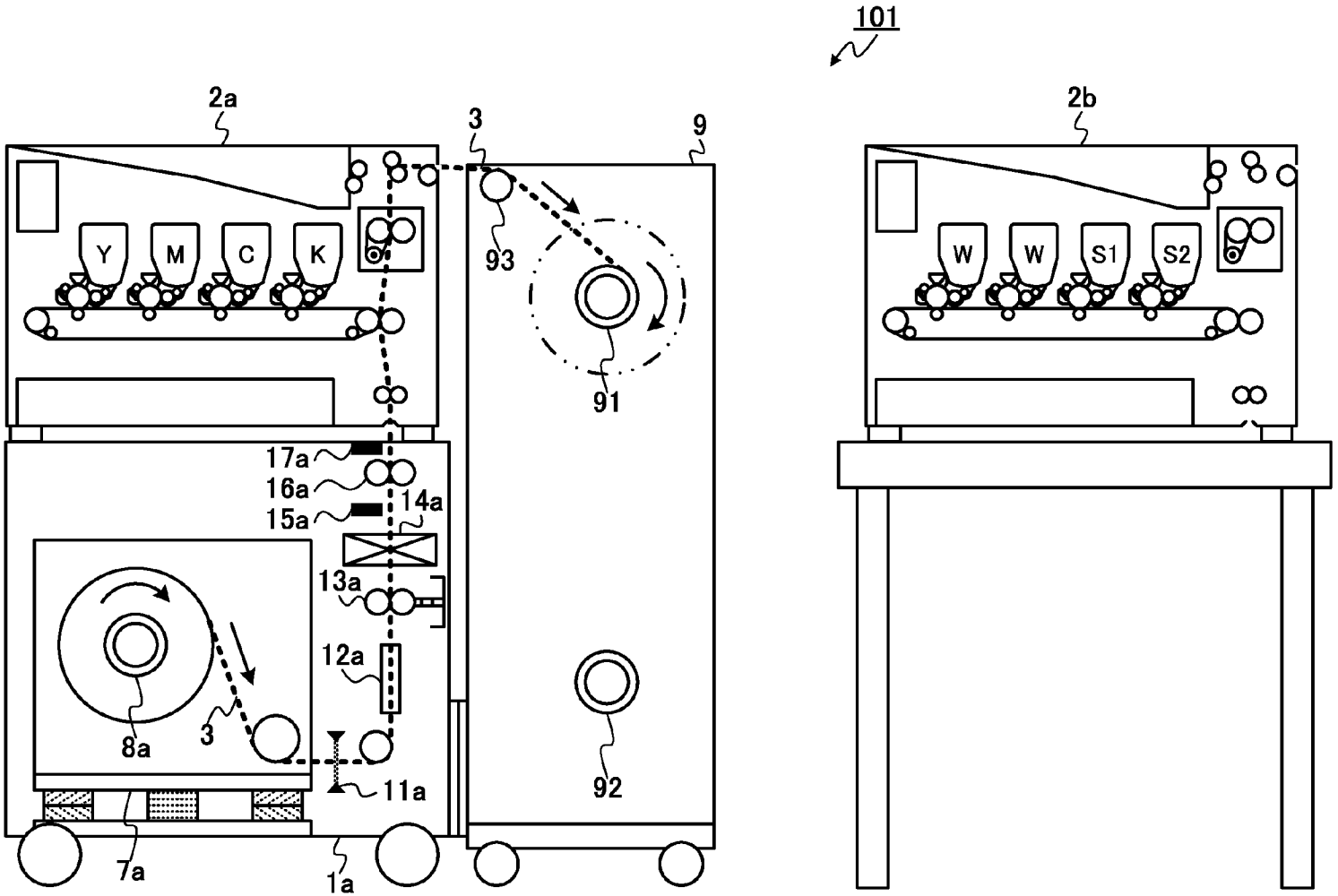
FIG. 16 is a drawing showing the composition of a printing system according to a second exemplary embodiment of the present disclosure.

FIG. 16 shows the composition of a printing system according to the second exemplary embodiment. A printing system 101 comprises an image-forming apparatus 2*a* for forming images using developing agent in the four colors of YMCK, an image-forming apparatus 2*b* for forming images using developing agent in special colors other than YMCK, a paper supply apparatus 1*a* and a winding apparatus 9. That is to say, the printing system 100 according to the above-described first exemplary embodiment was provided with two paper supply apparatuses 1*a* and 1*b*. In contrast, the printing system 101 according to the second exemplary embodiment is not provided with a second paper supply apparatus 1*b*.

During the first image formation with normal colors (the four colors of YMCK), as shown in FIG. 16 the image-forming apparatus 2*a* that functions as the first image-forming unit is placed on top of the paper supply apparatus 1*a*. Furthermore, the paper supply apparatus 1*a* and the image-forming apparatus 2*a* constitute a system equivalent to the normal color printing system 10*a* in the first exemplary embodiment.

Figure 17:
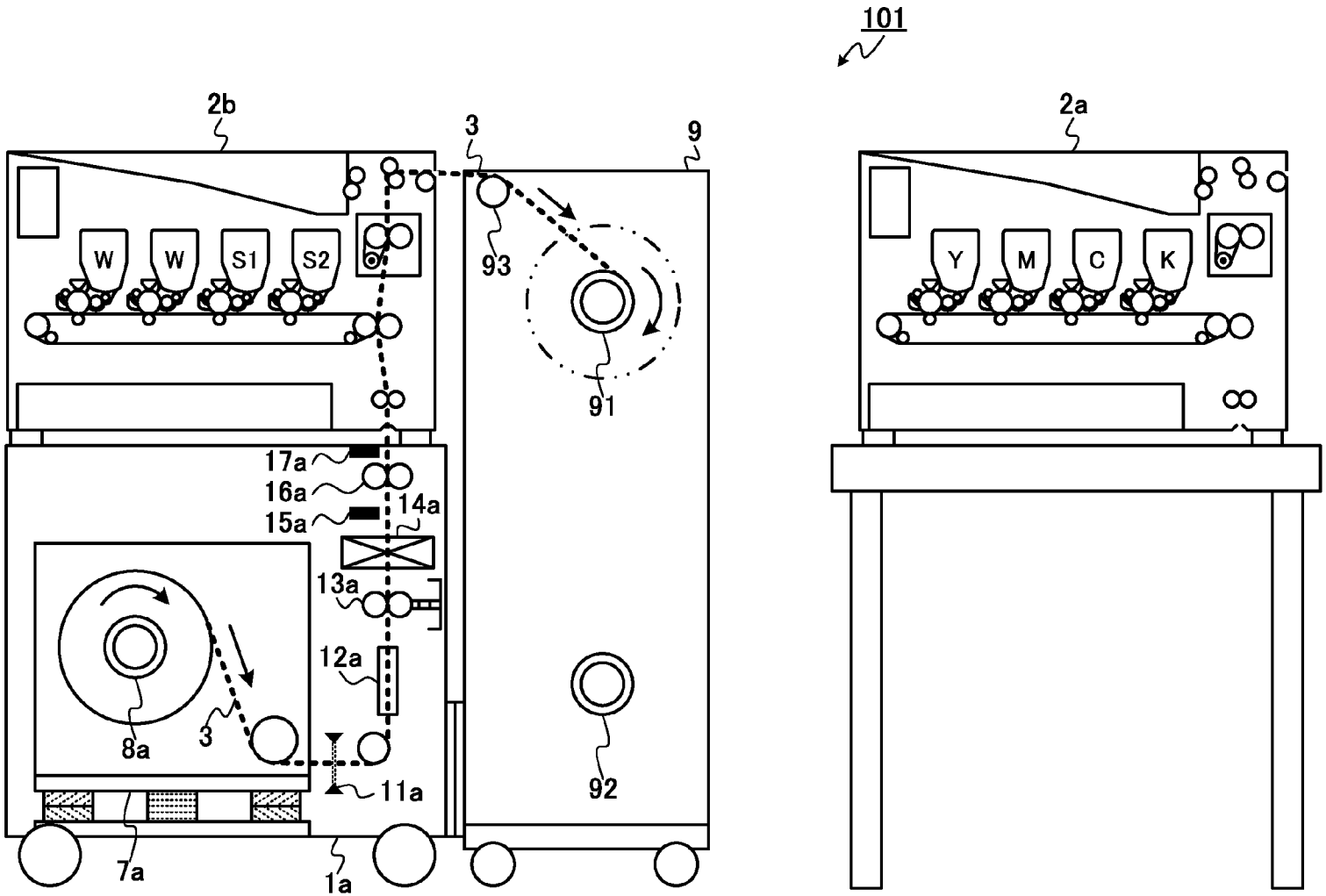
FIG. 17 is a drawing showing the state when the second image formation is accomplished in the printing system according to the second exemplary embodiment.

On the other hand, during the second image formation with special colors (white, and/or the like), as shown in FIG. 17 the image-forming apparatus 2*b* that functions as the second image-forming unit is placed on top of the paper supply apparatus 1*a* in place of the image-forming apparatus 2*a*. Furthermore, the paper supply apparatus 1*a* and the image-forming apparatus 2*b* constitute a system equivalent to the special color printing system 10*b* in the first exemplary embodiment.

That is to say, the paper supply apparatus 1*a* in the second exemplary embodiment functions as both of the two paper supply apparatuses 1*a* and 1*b* in the first exemplary embodiment. For example, the holder 8*a* provided in the paper supply apparatus 1*a* holds the roll paper 3 prior to images being formed by the image-forming apparatus 2*a* functioning as the first image-forming unit, and also functions as a holder that further holds the roll paper 3 after image formation by the image-forming apparatus 2*a* and winding by the winder 97. The unwinder 82*a* functions as a first unwinder that unwinds the roll paper 3 held by the holder 8*a* and supplies the roll paper 3 to the image-forming apparatus 1*a*, and functions as a second unwinder that unwinds the roll paper 3 held by the holder 8*a* and supplies the roll paper 3 to the image-forming apparatus 1*b*. The detector 84*a* functions as a first detector and a second detector for detecting the original mark 75 recorded in advance on the roll paper 3.

Through this kind of composition, it is possible for the printing system 101 according to the second exemplary embodiment to execute the same high-quality, multi-color printing with fewer constituent elements than the printing system 100 according to the first exemplary embodiment.

Third Exemplary Embodiment

Below, a printing system according to a third exemplary embodiment of the present disclosure is described.

Figure 18:
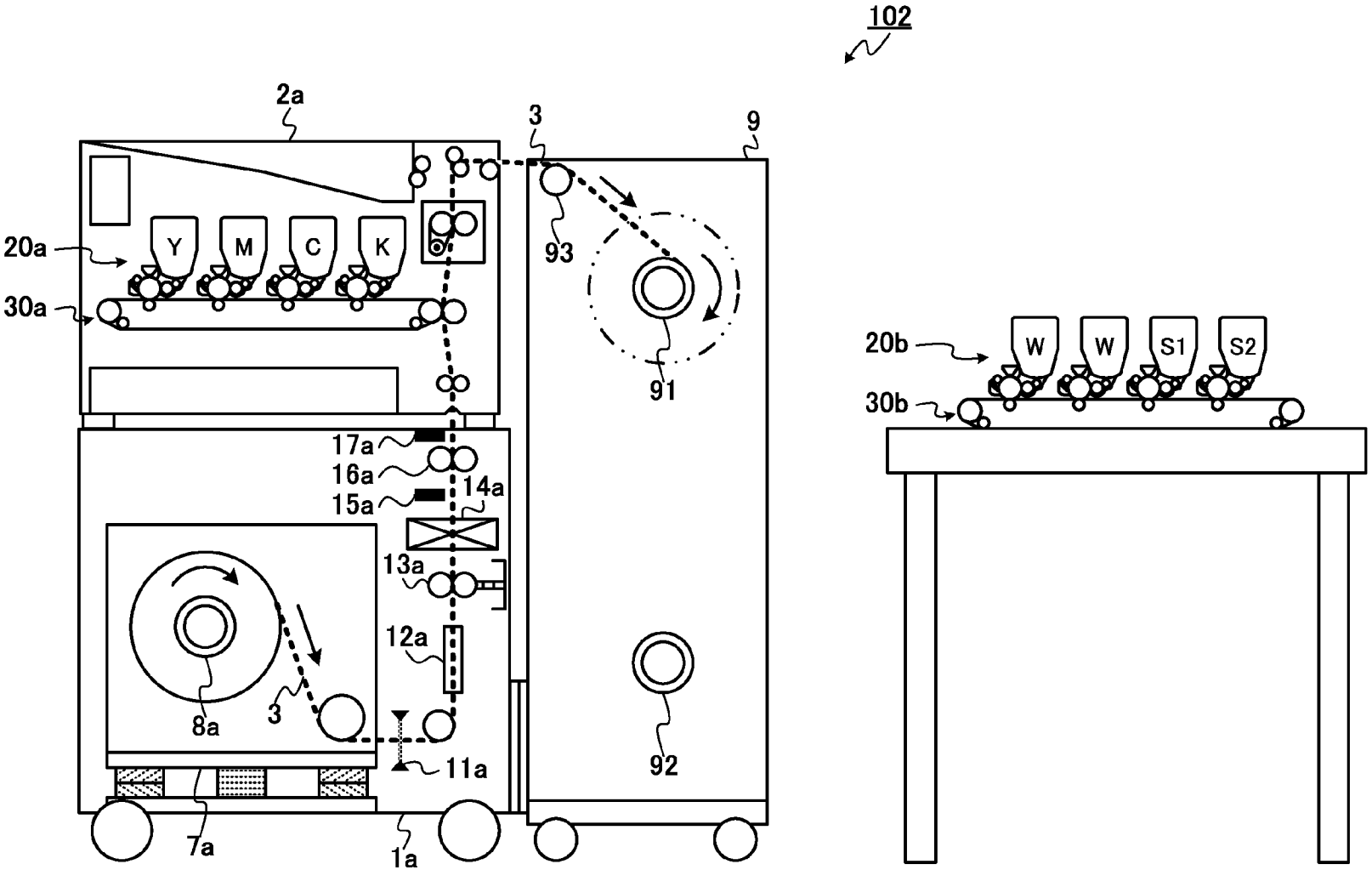
FIG. 18 is a drawing showing the composition of a printing system according to a third exemplary embodiment of the present disclosure.

FIG. 18 shows the composition of a printing system according to a third exemplary embodiment. The printing system 102 comprises an image-forming apparatus 2*a* for forming images using developing agent in the four colors of YMCK, an image-forming unit 20*b* for forming images using developing agent in special colors other than YMCK, an intermediate transfer belt unit 30*b*, a paper supply apparatus 1*a* and a winding apparatus 9. That is to say, the printing system 101 according to the above-described second exemplary embodiment was provided with two image-forming apparatuses 2*a* and 2*b*. In contrast, the printing system 102 according to the third exemplary embodiment is not provided with the second image-forming apparatus 2*b*.

During the first image formation with normal colors (the four colors of YMCK), as shown in FIG. 18 the image-forming apparatus 2*a* comprising the intermediate transfer belt unit 30*a* and the image-forming unit 20*a* including the Image-forming parts 21*y*, 21*m*, 21*c* and 21*k* for the four colors of YMCK functions as the first image-forming unit.

Figure 19:
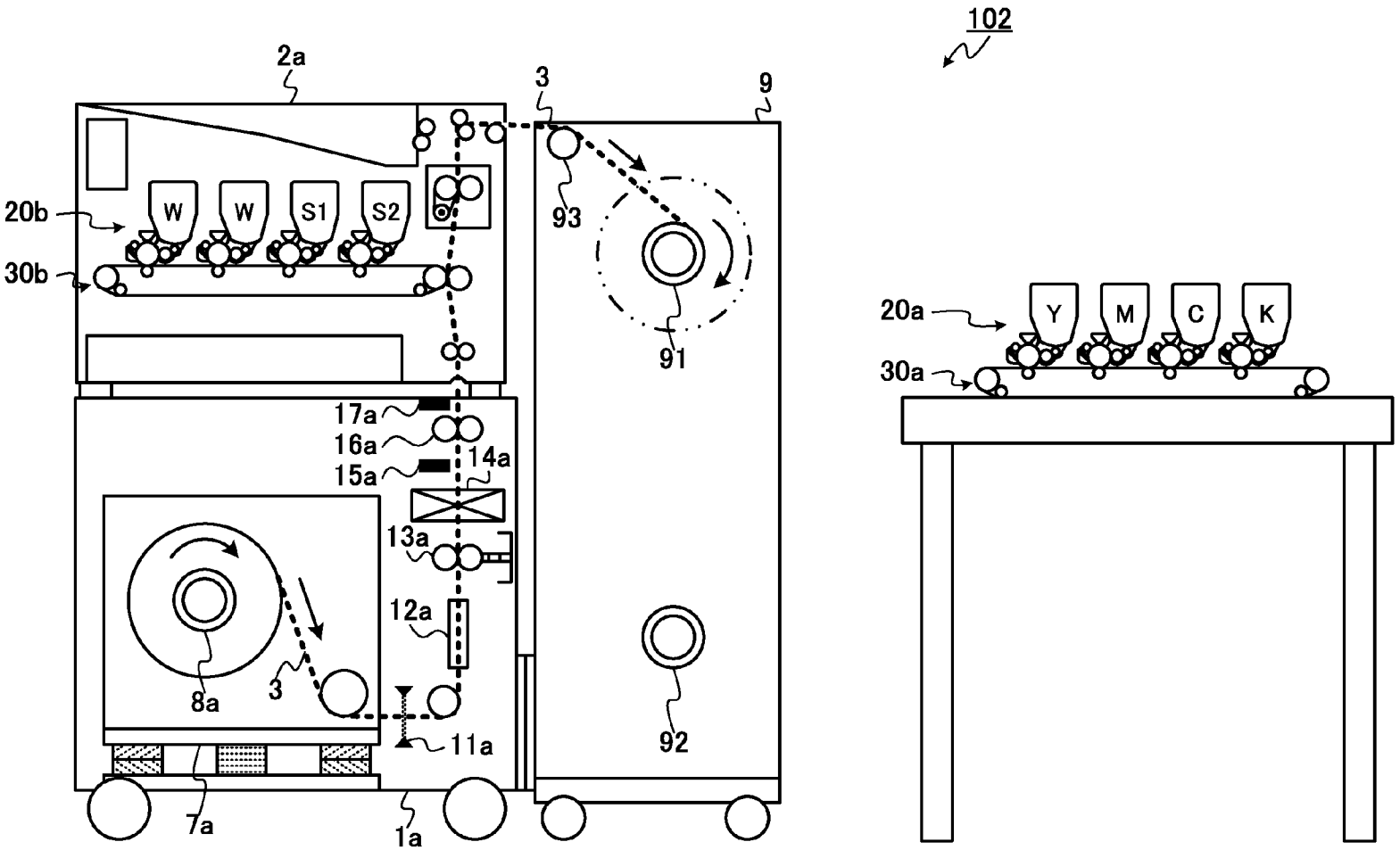
FIG. 19 is a drawing showing the state when the second image formation is accomplished in the printing system according to the third exemplary embodiment.

On the other hand, during the second image formation with special colors (white and/or the like), as shown in FIG. 19 the image-forming unit 20*a* and the intermediate transfer belt unit 30*a* inside the image-forming unit 2*a* are respectively replaced by the image-forming unit 20*b* including Image-forming parts 21*w*1, 21*w*2, 21*s*1 and 21*s*2 for special colors and the intermediate transfer belt unit 30*b*. Furthermore, the image-forming apparatus 2*a* comprising the image-forming unit 20*b* and the intermediate transfer belt unit 30*b* functions as the second image-forming unit.

That is to say, with the printing system 102 according to the third exemplary embodiment, one image-forming apparatus 2*a* removably houses constituent elements including image-forming units 21, and functions as both the first image-forming unit and the second image-forming unit. As a result, it is possible for the printing system 102 according to the third exemplary embodiment to execute the same high-quality, multi-color printing with fewer constituent elements than the printing system 101 according to the second exemplary embodiment.

(Variations)

The exemplary embodiments of the present disclosure were described above, but the above-described exemplary embodiments are intended to be illustrative and not limiting. That is to say, the exemplary embodiments of the present disclosure have various applications, and all variations should be included within the scope of the present disclosure.

For example, in the above-described exemplary embodiments, the image-forming apparatus 1*a* functioning as the first image-forming unit formed images using developing agent in normal colors (the four colors of YMCK) and the image-forming apparatus 1*b* functioning as the second image-forming unit formed images using developing agent in special colors (colors other than YMCK, including white). However, the combinations of colors of developing agent in the first image-forming unit and the second image-forming unit are not limited thereby, as any combination would be fine.

In addition, in the above-described exemplary embodiments, an original mark 75 was recorded in advance as a reference mark on the roll paper 3. However, in the printing system according to the present disclosure, if it is possible to form the first toner image on the roll paper 3 using another positioning reference, it is possible to use roll paper 3 in which the original mark 75 is not recorded.

When the original mark 75 is not recorded in advance on the roll paper 3, in the normal color printing system 10*a* the image-forming apparatus 2*a* records a reference mark when executing the first image formation on the roll paper 3 unwound by the unwinder 82*a*. To explain more specifically, the image-forming apparatus 2*a* records a reference mark at constant intervals at multiple positions including near the beginning edge 77 (for example, at the front end of the region where the first developing agent image is formed) of the roll paper 3. Furthermore, in the succeeding special color printing system 10*b*, the detector 84*b* detects the reference mark recorded on the roll paper 3 and the image-forming apparatus 2*b* executes the second image formation with the reference mark as a position reference. Through this, poisoning in second image formation is easy even when no original mark 75 is recorded in advance on the roll paper 3.

In addition, in the above-described exemplary embodiments, the printing systems 100, 101 and 102 executed multi-color printing on the roll paper 3. However, the printing system according to the present disclosure is not limited to a paper medium, that is to say the roll paper 3, and may execute multi-color printing on a roll-wound recording medium of another material, such as a film recording medium and/or the like.

While it is naturally possible to provide a composition for realizing the functions according to the present disclosure as a printing system prepared in advance, it is also possible through application of programs to cause an existing information processing apparatus and/or the like to function as the printing system according to the present disclosure. That is to say, it is possible for a program for realizing the functional composition of the printing systems 100, 101 and 102 illustrated by the above-described exemplary embodiments to be executed by a CPU and/or the like controlling an existing information processing apparatus and/or the like and through this to cause the apparatus to function as the printing system according to the present disclosure. In addition, it is possible for the printing method according to the present disclosure to be executed using the printing system.

In addition, the method of applying this kind of program is arbitrary. The program can be stored on a computer-readable non-transitory recording medium such as a flexible disk, CD (Compact Disc)-ROM, DVD (Digital Versatile Disc)-ROM, memory card and/or the like. Furthermore, it is possible to overlay the program on carrier waves and to apply such via a communications medium such as the Internet and/or the like. For example, it would be fine to post and distribute the program via a BBS (Bulletin Board System) on a communication network. Furthermore, it would be fine to have a composition such that the above-described processes can be executed by activating this program and similarly executing other application programs under control of the OS (Operating System).

Modifications and variations can be made without departing from broader spirit and scope of the present disclosure. It should be noted that the above embodiments are meant only to be illustrative of those embodiments and are not intended to be limiting the scope of the present disclosure. Accordingly, the scope of the present disclosure should not be determined by the embodiments illustrated, but by the appended claims. It is therefore the intention that the present disclosure be interpreted to include various modifications that are made within the scope of the claims and their equivalents.

What is claimed is:

1. A printing apparatus, comprising:

a printing unit that prints images of four colors on a recording medium unwound by an unwinder;

a first winder that winds the printed recording medium around a first winding shaft in order from a beginning edge to an ending edge of the recording medium; and a second winder that rewinds the recording medium wound around the first winding shaft, and winds the rewound recording medium around a second winding shaft in order from the ending edge to the beginning edge of the recording medium, after which the recording medium is suppliable to another printing apparatus that prints images having a maximum of four colors, which are different from the four colors of the images printed by the printing unit, on a surface of the recording medium on which the images of the four colors were printed by the printing unit;

wherein the recording medium unwound by the unwinder is arranged below the printing unit; and wherein the second winding shaft is arranged below the first winding shaft.

2. The printing apparatus according to claim 1, wherein:

a reference mark is recorded in advance on the recording medium; and the printing unit further comprises a detector that detects the reference mark on the recording medium, and prints an image on the recording medium using a position of the detected reference mark as a reference.

3. The printing apparatus according to claim 1, wherein the first winding shaft and the second winding shaft are each provided to be perpendicular to a common surface so that extending directions of the first winding shaft and the second winding shaft are mutually parallel.

4. A printing system, comprising:

a first image-forming unit that forms a first developing agent image with four colors of developing agent on a recording medium unwound by a first unwinder;

a first winder that winds the recording medium on which the first developing agent image was formed around a first winding shaft in order from a beginning edge to an ending edge of the recording medium;

a second winder that rewinds the recording medium wound around the first winding shaft, and winds the rewound recording medium around a second winding shaft in order from the ending edge to the beginning edge of the recording medium;

a second unwinder that unwinds the recording medium wound around the second winding shaft in order from the beginning edge to the ending edge of the recording medium; and a second image-forming unit that forms a second developing agent image with a maximum of four colors of developing agent, which are different from the four colors used to form the first developing agent image, on a surface of the recording medium unwound by the second unwinder on which the first developing agent image was formed, wherein the recording medium unwound by the first unwinder is arranged below the first image-forming unit, and wherein the second winding shaft is arranged below the first winding shaft.

5. The printing system according to claim 4, wherein:

a reference mark is recorded in advance on the recording medium;

the printing system further comprises a first detector that detects the reference mark recorded on the recording medium unwound by the first unwinder; and the first image-forming unit forms the first developing agent image on the recording medium using the reference mark detected by the first detector as a position reference.

6. The printing system according to claim 5, further comprising:

a second detector that detects the reference mark recorded on the recording medium unwound by the second unwinder; and the second image-forming unit forms the second developing agent image on the surface of the recording medium on which the first developing agent image was formed, using the reference mark detected by the second detector as a second position reference.

7. The printing system according to claim 4, wherein:

the first image-forming unit forms a reference mark on the recording medium unwound by the first unwinder;

the printing system further comprises a detector that detects the reference mark recorded on the recording medium unwound by the second unwinder; and the second image-forming unit forms the second developing agent image on the surface of the recording medium on which the first developing agent image was formed, using the reference mark detected by the detector as a position reference.

8. The printing system according to claim 4, wherein the first winding shaft and the second winding shaft are each provided to be perpendicular to a common surface so that extending directions of the first winding shaft and the second winding shaft are mutually parallel.

9. The printing system according to claim 4, further comprising:

a first holder that holds the recording medium prior to the first developing agent image being formed by the first image-forming unit; and a second holder that holds the recording medium after the first developing agent image is formed by the first image-forming unit and after the recording medium has been wound by the second winder;

wherein the first unwinder unwinds the recording medium held by the first holder in order from the beginning edge to the ending edge of the recording medium and supplies the recording medium to the first image-forming unit; and the second unwinder unwinds the recording medium held by the second holder in order from the beginning edge to the ending edge of the recording medium, and supplies the recording medium to the second image-forming unit.

10. The printing system according to claim 4, further comprising:

a holder that holds the recording medium prior to the first developing agent image being formed by the first image-forming unit;

wherein the first unwinder unwinds the recording medium held by the holder in order from the beginning edge to the ending edge of the recording medium, and supplies the recording medium to the first image-forming unit;

the holder further holds the recording medium after the first developing agent image is formed by the first image-forming unit and the recording medium is wound by the second winder; and the second unwinder unwinds the recording medium held by the holder in order from the beginning edge to the ending edge of the recording medium, and supplies the recording medium to the second image-forming unit.

11. The printing system according to claim 4, wherein:

the first image-forming unit forms the first developing agent image with developing agent in yellow, magenta, cyan and black; and the second image-forming unit forms the second developing agent image with developing agent of at least one color out of white, gold, silver, transparent and a special color for providing fluorescence or gloss.

12. The printing system according to claim 11, wherein:

the second image-forming unit forms two white developing agent images with the developing agent of white, and forms the second developing agent image by overlaying the two white developing agent images.

13. A printing method for a printing system, the printing system comprising: a first image-forming unit; a first unwinder; a first winder; a second winder; a second unwinder; and a second image-forming unit, and the method comprising:

forming, by the first image-forming unit, a first developing agent image of four colors on a recording medium unwound by the first unwinder;

winding, by the first winder, the recording medium on which the first developing agent image was formed by the first image-forming unit around a first winding shaft in order from a beginning edge to an ending edge of the recording medium;

rewinding, by the second winder, the recording medium wound by the first winder around the first winding shaft, and winding, by the second winder, the rewound recording medium around a second winding shaft in order from the ending edge to the beginning edge of the recording medium;

unwinding, by the second unwinder, the recording medium wound by the second winder around the second winding shaft in order from the beginning edge to the ending edge of the recording medium; and forming, by the second image-forming unit, a second developing agent image of a maximum of four colors, which are different from the four colors of the first developing agent image, on a surface of the recording medium unwound by the second winder on which the first developing agent image was formed, wherein the recording medium unwound by the first unwinder is arranged below the first image-forming unit, and wherein the second winding shaft is arranged below the first winding shaft.

14. A non-transitory computer-readable recording medium having stored thereon a program executable by a computer of a printing system, the printing system further comprising: a first image-forming unit; a first unwinder; a first winder; a second winder; a second unwinder; and a second image-forming unit, and the program being executable to control the computer to perform functions comprising:

controlling the first image-forming unit to form a first developing agent image of four colors on a recording medium unwound by the first unwinder;

controlling the first winder to wind the recording medium, on which the first developing agent image was formed by the first-image forming unit, around a first winding shaft in order from a beginning edge to an ending edge of the recording medium;

controlling the second winder to (i) rewind the recording medium wound by the first winder around the first winding shaft, and (ii) wind the rewound recording medium around a second winding shaft in order from the ending edge to the beginning edge of the recording medium;

controlling the second unwinder to unwind the recording medium wound by the second winder around the second winding shaft, in order from the beginning edge to the ending edge of the recording medium; and controlling the second image-forming unit to form a second developing agent image of a maximum of four colors, which are different from the four colors of the first developing agent image, on a surface of the recording medium unwound by the second unwinder on which the first developing agent image was formed, wherein the recording medium unwound by the first unwinder is arranged below the first image-forming unit, and wherein the second winding shaft is arranged below the first winding shaft.

* * * * *